United States Patent [19]

Klostermann et al.

[11] Patent Number: 4,964,148

[45] Date of Patent: Oct. 16, 1990

[54] AIR COOLED METAL CERAMIC X-RAY TUBE CONSTRUCTION

[75] Inventors: Heinrich F. Klostermann, Menlo Park; Martin Braun, San Jose, both of Calif.

[73] Assignee: Meicor, Inc., Clearwater, Fla.

[21] Appl. No.: 273,553

[22] Filed: Nov. 21, 1988

Related U.S. Application Data

[63] Continuation-in-part of Ser. No. 126,842, Nov. 30, 1987.

[51] Int. Cl.[5] ..... H01J 35/10; H01J 35/26

[52] U.S. Cl. ..... 378/127; 378/121; 378/140; 378/142

[58] Field of Search ..... 378/121, 125, 132, 140–142, 378/144, 102

[56] References Cited

U.S. PATENT DOCUMENTS

| | | | |
|---|---|---|---|
| 1,715,151 | 5/1929 | Ulrey et al. | 378/142 |
| 2,040,156 | 5/1936 | Slack et al. | 378/141 |
| 2,090,582 | 8/1937 | Mesick | 378/125 |
| 2,121,632 | 6/1938 | Gross et al. | 378/131 |
| 2,345,723 | 4/1944 | Atlee et al. | 378/125 |
| 4,187,442 | 2/1980 | Hueschen et al. | 378/128 |
| 4,355,410 | 10/1982 | Sullins | 378/199 |
| 4,468,802 | 8/1984 | Friedel | 378/140 |
| 4,514,204 | 4/1985 | Bonney et al. | 62/55.5 |
| 4,545,064 | 10/1985 | Klostermann | 378/132 |
| 4,670,895 | 6/1987 | Penato et al. | 378/144 |
| 4,674,109 | 6/1987 | Ono | 378/144 |
| 4,811,375 | 3/1989 | Klostermann | 378/121 |

*Primary Examiner*—Craig E. Church
*Assistant Examiner*—John C. Freeman
*Attorney, Agent, or Firm*—Flehr, Hohbach, Test, Albritton & Herbert

[57] ABSTRACT

X-ray tube construction comprising a housing with a metal tube envelope therein and a shaft. An anode plate is carried by the shaft. Bearings are disposed on opposite sides of the anode plate and rotatably mount the shaft in the envelope. A motor drive is coupled to the shaft for rotating the shaft and the anode plate carried thereby. A cathode is provided for supplying electrons which are accelerated by a high voltage to the anode plate for creating x-rays upon impingement with the anode plate. A heat cage is disposed in the housing and the envelope and surrounds the anode plate. X-ray shielding is disposed within the housing between the envelope and the housing. Windows are provided in the shielding, the metal envelope and in the heat cage to permit x-rays to pass therethrough. Particularly novel means is provided for dissipating the heat generated in the anode and for dissipating the same exterior of the housing prior to the heat passing to the opposite extremities of the shaft. Shaft constructions have been utilized which inhibit the travel of heat to the opposite ends of the shafts and thereby serving to protect the bearings rotatably supporting the shaft.

36 Claims, 11 Drawing Sheets

AIR COOLED METAL CERAMIC X-RAY TUBE CONSTRUCTION

This application is a continuation-in-part of application Ser. No. 126,842 filed on Nov. 30, 1987.

This invention relates to x-ray tubes and more particularly to air cooled metal ceramic x-ray tubes.

Typically in conventional x-ray tubes both the anode and the cathode are vacuum sealed in a glass envelope. Electrons released by the hot cathode filament are accelerated toward the anode by a high voltage. These high energy electrons generate x-rays upon impact on the solid anode and at the same time generate copious amounts of heat. The tube is mounted in a housing to protect the environment from unwanted x-rays. The housing typically of a rotating anode x-ray tube is filled with oil to provide electrical insulation and also to absorb heat generated by the anode. Such conventional x-ray tubes have numerous disadvantages including high cost and relatively short lifetimes. The oil cooling utilized greatly increases the cost of insulation and also inhibits repair of the same. There is therefore a need for a new and improved x-ray tube construction which overcomes these disadvantages.

In general it is the object of the present invention to provide an x-ray tube construction which utilizes metal and ceramic in its construction rather than a glass envelope.

Another object of the invention is to provide a construction of the above character which can be manufactured to high precision allowing the incorporation of double-ended bearings.

Another object of the invention is to provide an x-ray tube construction of the above character in which a precise focal spot alignment can be obtained.

Another object of the invention is to provide an x-ray tube construction of the above character in which arcing created by filament evaporation onto glass is eliminated.

Another object of the invention is to provide an x-ray tube construction of the above character in which the back scattered electrons are absorbed by surrounding metal resulting in less off focus radiation and improved image contrast.

Another object of the invention is to provide an x-ray tube construction of the above character in which the bearings are protected from heat dissipated from the anode.

Another object of the invention is to provide an x-ray tube construction of the above character in which the feedthroughs and in particular the cathode feedthrough is protected from the anode heat.

Another object of the invention is to provide an x-ray tube construction of the above character which can withstand higher temperatures than can be accommodated with glass tubes.

Another object of the invention is to provide an x-ray tube construction of the above character in which greatly improved heat dissipating qualities have been incorporated into the tube.

Another object of the invention is to provide an x-ray tube construction of the above character having an improved x-ray window construction.

Another object of the invention is to provide an x-ray tube construction of the above character which includes improved cable terminations.

Another object of the invention is to provide an x-ray tube construction of the above character in which the high voltage receptacles provided can accommodate various types of federal standard terminals.

Another object of the invention is to provide an x-ray tube construction of the above character in which different types of high temperature shafts can be accommodated.

Another object of the invention is to provide an x-ray tube construction of the above character having high temperature shafts which carry heat emissive coatings thereon to facilitate the emission of heat from the shaft.

Another object of the invention is to provide an x-ray tube construction of the above character which eliminates the need for an insulating oil bath and which can operate with and without forced air cooling.

Another object of the invention is to provide an x-ray tube construction of the above character which is of reduced size and weight.

Another object of the invention is to provide an x-ray tube construction of the above character in which the bearing life is improved dramatically.

Another object of the invention is to provide an x-ray tube construction of the above character which makes possible the use of heavier anodes with resulting higher heat storage capacity.

Another object of the invention is to provide an x-ray tube construction of the above character in which a heat cage is provided which is thermally extended to the rear end of the tube to provide an efficient heat exchange with forced air cooling.

Another object of the invention is to provide an x-ray tube construction of the above character in which forced air cooling is utilized.

Another object of the invention is to provide an x-ray tube construction of the above character in which heat dissipated from the anode is diverted to the exterior before reaching the extremities of the shaft.

Another object of the invention is to provide an x-ray tube construction of the above character in which the shielding is in intimate contact with the aluminum housing and the stainless steel envelope to provide excellent heat transfer characteristics.

Another object of the invention is to provide an x-ray tube construction of the above character in which replacement of the tube in the field can be readily accomplished.

Another object of the invention is to provide an x-ray tube construction of the above character in which a ceramic coupling is provided between the shaft and the rotor permitting the rotor to operate at the same ground potential as the stator.

Another object of the invention is to provide an x-ray tube construction of the above character in which intimate electromagnetic coupling is achieved between the rotor and the stator.

Another object of the invention is to provide an x-ray tube construction of the above character in which the anode can be rapidly accelerated and decelerated.

Another object of the invention is to provide an x-ray tube construction of the above character which can lend itself to compact lightweight applications such as for mobile systems, C-ARM and mammography.

Another object of the invention is to provide an x-ray tube construction of the above character in which microfocus x-ray spots can be obtained.

Another object of the invention is to provide an x-ray tube construction of the above character which permits a higher anode speed making possible reduced anode diameter without losing power capability and the requirements needed for mammography and other similar applications.

Another object of the invention is to provide an x-ray tube construction of the above character which can provide multiple focal spots with three or four-pole federal standard terminals.

Another object of the invention is to provide an x-ray tube construction of the above character in which high voltage receptacles are provided with inserts having pins therein which can be readily adjusted to accommodate either the three pole or four pole federal standard terminations.

Another object of the invention is to provide an x-ray tube construction of the above character which utilizes a heat cage which is sealed in such a manner so as to provide a vacuum and also to provide excellent heat transfer through the heat cage.

Another object of the invention is to provide an x-ray tube construction of the above character which is provided with a heat cage which has been formed utilizing an electron beam weld to establish good mechanical contact to facilitate the transfer of heat.

Another object of the invention is to provide an x-ray tube of the above construction which has been assembled in such a manner so that there are compensating movements of the rotor shaft during operation of the x-ray tube so that the anode remains in a relatively stationary position with respect to the movement longitudinally of the axis of the shaft.

Another object of the invention is to provide an x-ray tube construction of the above character in which the cooling fins are brazed directly to the heat cage.

Another object of the invention is to provide an x-ray tube construction of the above character in which special means is provided to minimize the effects of corona.

Another object of the invention is to provide an x-ray tube construction of the above character in which a heat choke is provided for protecting the rear bearing.

Another object of the invention is to provide an x-ray tube construction of the above character in which a split squirrel cage motor is utilized.

Another object of the invention is to provide an x-ray tube construction of the above character in which the squirrel cage rotor is comprised of magnetic steel segments encased in copper.

Another object of the invention is to provide an x-ray tube construction of the above character in which the cathode feed through is offset from the high voltage terminals to minimize heating of the insulating material provided in and around the high voltage terminals.

Another object of the invention is to provide an x-ray tube construction of the above character which can be readily repaired.

Additional objects and features of the invention will appear from the following description in which the preferred embodiments are set forth in the accompanying drawings.

Figure 1:
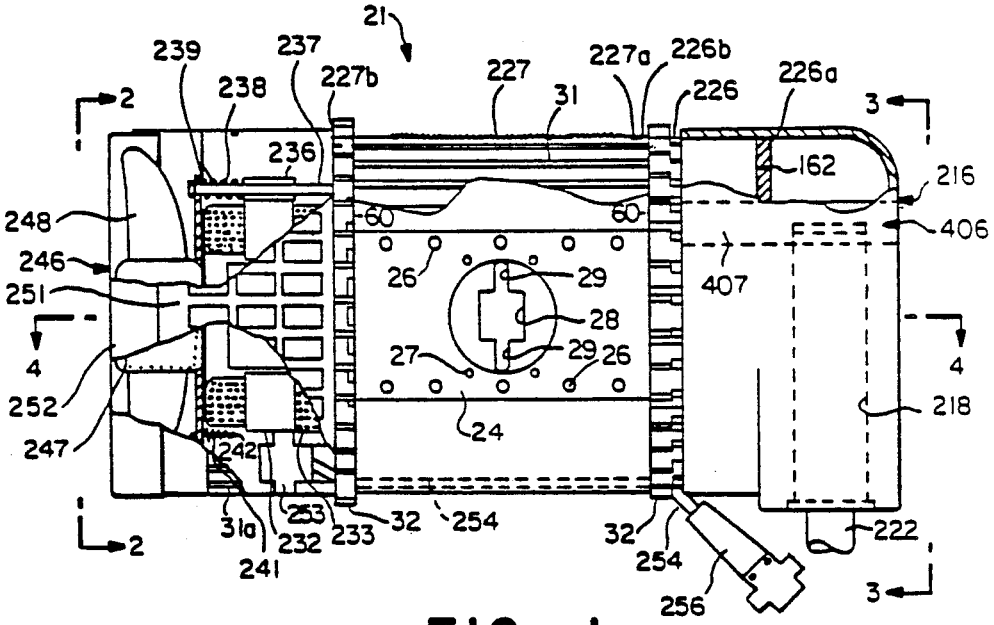
FIG. 1 is a side elevational view with certain portions broken away of a air cooled metal ceramic x-ray tube construction incorporating the present invention.
Figure 2:
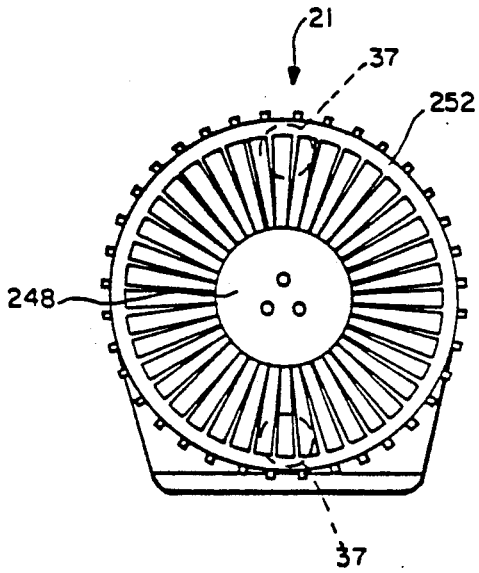
FIG. 2 is an end view looking along the line 2—2 of FIG. 1.
Figure 3:
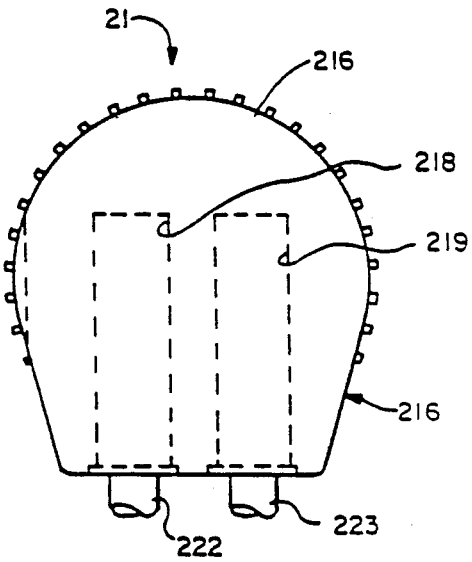
FIG. 3 is an end view looking along the line 3—3 of FIG. 1
Figure 4:
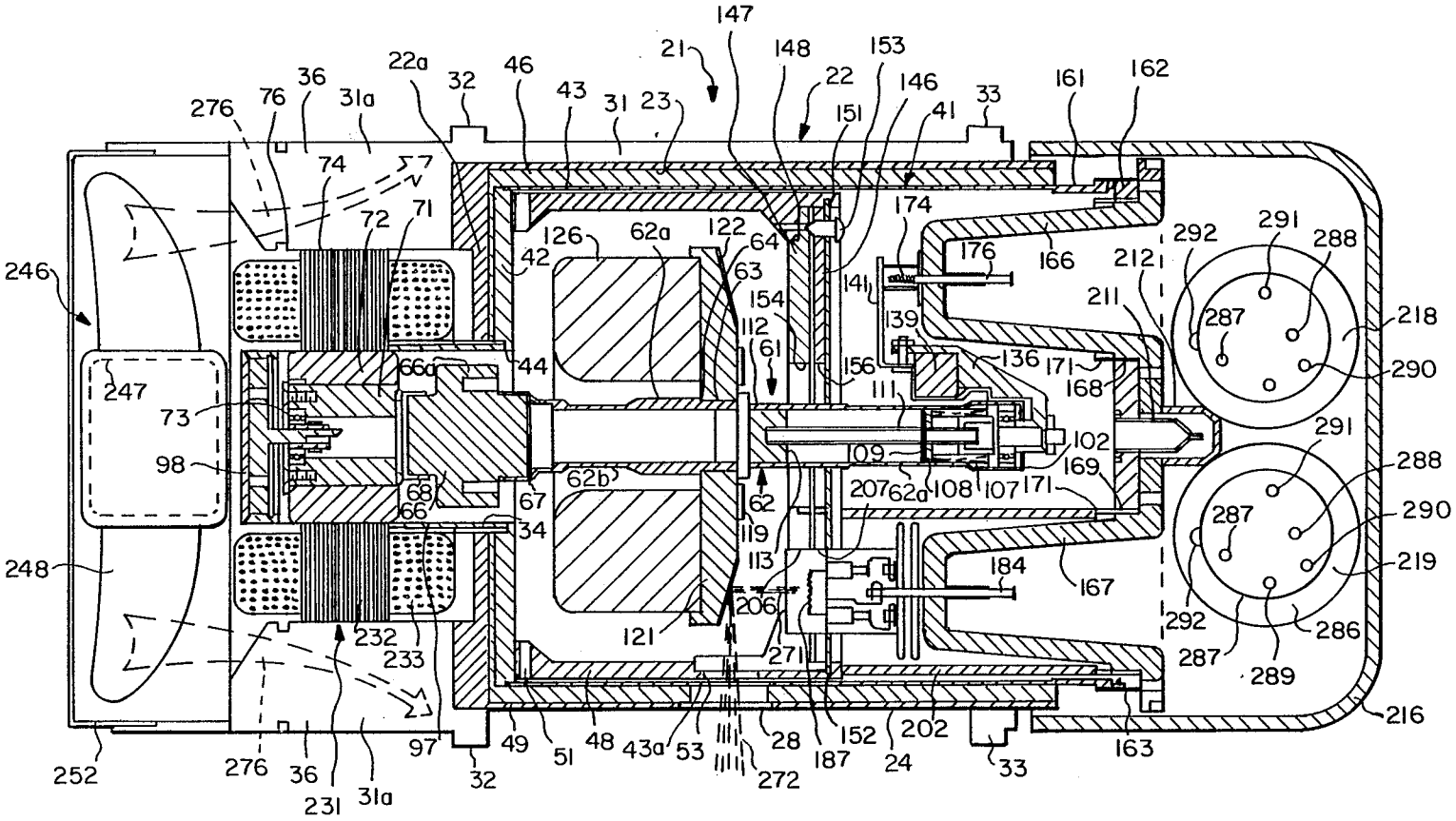
FIG. 4 is a cross sectional view taken along the line 4—4 of FIG. 1.
Figure 7:
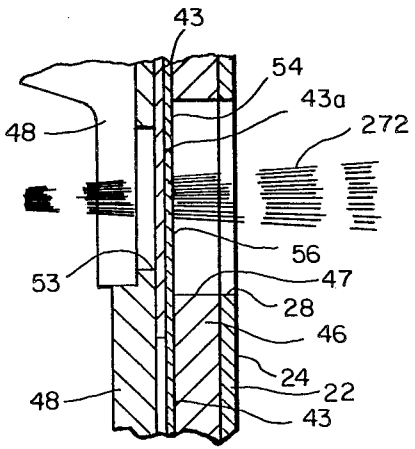
FIG. 7 is an enlarged cross-sectional view showing the construction of the x-ray tube in the vicinity of the x-ray window.
Figure 6:
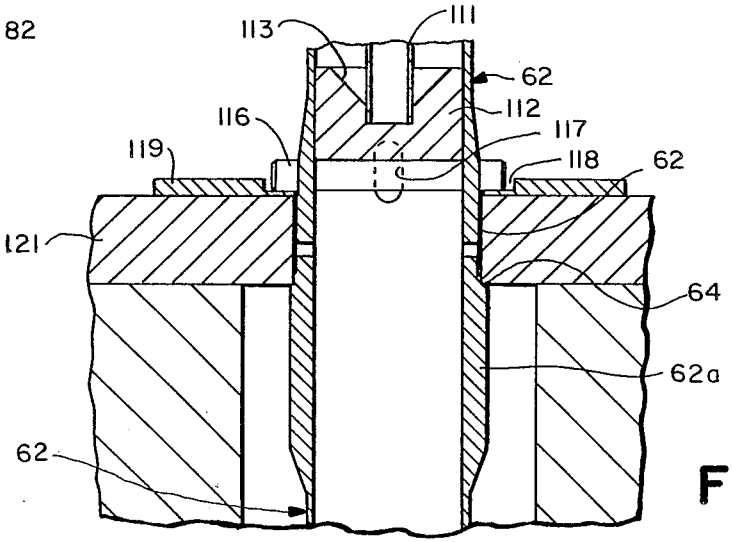
FIG. 6 is an enlarged cross-sectional view of the central portion of the drive shaft and showing the anode plate mounted thereon.
Figure 5:
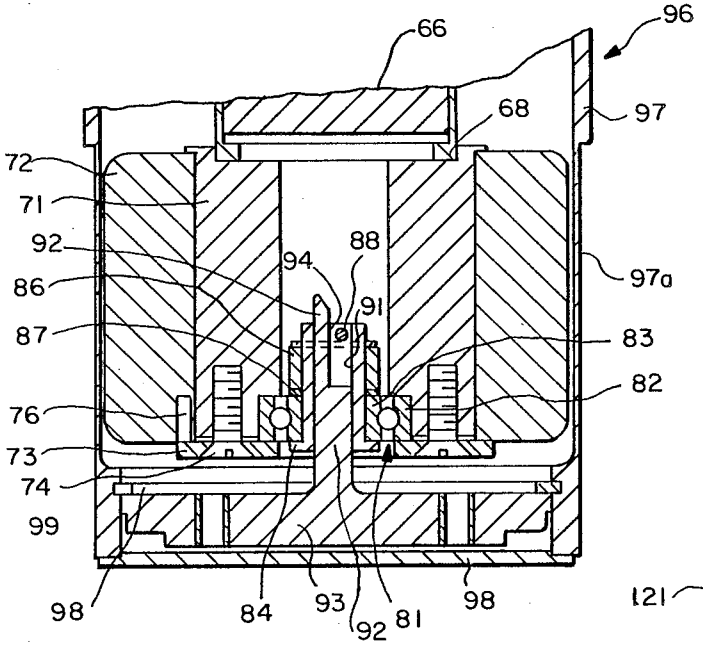
FIG. 5 is an enlarged partial cross-sectional view showing the rear bearing construction utilized in the construction shown in FIG. 4.
Figure 10:
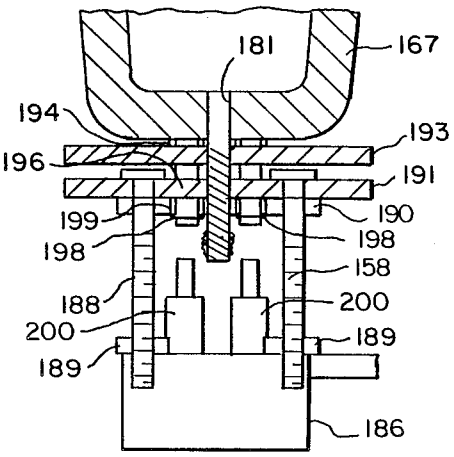
FIG. 10 is a cross-sectional view showing the cathode feedthrough and cathode assembly rotated by 90° from that shown in FIG. 9 but omitting the male banana type plugs and the spring metal clamps.

In general, the x-ray tube construction of the present invention is comprised of a housing with a metal tube envelope therein and a shaft. An anode plate is carried by the shaft. Bearings are disposed on opposite sides of the anode plate and rotatably mount the shaft in the envelope. A motor drive is coupled to the shaft for rotating the shaft and the anode plate carried thereby. A cathode is provided for supplying electrons which are accelerated by a high voltage to the anode plate for creating x-rays upon impingement with the anode plate. A heat cage is disposed in the housing and the envelope and surrounds the anode plate. X-ray shielding means is disposed within the housing between the envelope and the housing. Windows are provided in the shielding means, the metal envelope and in the heat cage to permit x-rays to pass therethrough. Particularly novel means is provided for dissipating the heat generated in the anode and for dissipating the same exterior of the housing prior to the heat passing to the opposite extremities of the shaft. Shaft constructions have been utilized which inhibit the travel of heat to the opposite ends of the shafts and thereby serving to protect the bearings rotatably supporting the shaft.

As shown more particularly in FIGS. 1–13 of the drawings, the air cooled metal ceramic x-ray tube construction 21 consists of a cylindrical housing 22 formed of a suitable material such as aluminum. The cylindrical housing 22 can be formed as an investment casting. The housing 22 is closed at one end and open at the other end to provide a cylindrical interior recess 23 which is coated to facilitate the adherence of lead thereto. For this purpose an electroless nickel plating is provided. The exterior of the cylindrical housing 22 is provided with a flat 24 on one side thereof which serves as a collimator support base. It is provided with a plurality of threaded holes 26 provided in two spaced parallel rows extending longitudinally of the housing and four additional threaded holes 27 disposed at the corners of an imaginary rectangle surrounding an opening 28 which can accommodate multipurpose windows to permit the x-ray tube 21 to be utilized for CT as well as conventional x-ray imaging As can be seen the opening 28 is basically in the form of a rectangle which can be utilized for conventional x-ray imaging. It is also provided with sidewardly extending slots 29 disposed on two sides of the rectangular opening 28 to facilitate use with a 60° fan beam for CT scanning.

The exterior surface of the cylindrical housing with the exception of the flat 24 is provided with longitudinally and radially extending fins 31 which are spaced circumferentially exterior of the cylindrical housing 22. The fins 31 serve as heat radiating fins. By way of example, 36 of such fins can be provided around the outer circumference of the housing 22. The housing 22 on its extremities is provided with trunnion interfaces 32 and 33 which as is well known to those skilled in the art are utilized for mounting the x-ray tube in the apparatus in which the tube is to be utilized. The closed end portion 22*a* of the cylindrical housing is provided with a centrally disposed hole 34 extending through the same. The portions 31*a* of the fins 31 extending longitudinally beyond the closed end portion 22*a* have slots 36 extending therethrough through which air can pass as hereinafter described. The housing is also provided with a pair of diametrically disposed cylindrical recesses 37 (see FIG. 2) which extend into and between two fins 31 and are adjusted to receive connectors of a conventional harness (not shown) to provide power for a purpose hereinafter described.

A cylindrical vacuum envelope 41 is mounted within the cylindrical recess 23 of the cylindrical housing 22. The vacuum envelope is open at one end. The vacuum envelope 41 is provided with a circular base 42 which has a thin walled cylindrical sleeve 43 secured thereto by suitable means such as welding or brazing. The base 42 can be formed of a suitable material such as copper of the type hereinafter described. The sleeve 43 can be formed of a suitable material such as stainless steel. The sleeve 43 is provided with thinned wall portion 43*a* which serves as a window through which x-rays can pass as hereinafter described. The thinned wall portion can be provided by machining a rectangular recess on the exterior surface of the sleeve 43 to provide a thinned wall portion 43*a* of a suitable thickness such as approximately 0.005 inches. The base 42 closes the other end and is provided with a hole 44 which is in registration with the hole 34 in the housing 22. A lead liner 46 is provided between the vacuum envelope 41 and the interior of the cylindrical housing 22. This lead envelope can be formed in a suitable manner such as by pouring molten lead into the space between the vacuum envelope 41 and the interior of the cylindrical housing 22. Since the interior wall of the cylindrical housing 22 has been coated with electroless nickel, the introduction of the lead into the cylindrical recess 23 causes a solder-like bond to be formed between the lead and the cylindrical housing 32 and the sleeve 43 of the tube envelope 41. The lead liner 46 serves two purposes, first as a massive heat sink for the x-ray tube construction and second as a shield against stray radiation which may attempt to pass from within the tube. Because of the excellent bond formed between the lead liner and the aluminum housing 22, there is good heat transfer from the lead to the housing and the fins 31 carried by the housing. A window 47 is provided in the lead liner 46 which is in registration with the opening 28.

A cylindrical heat cage 48 is provided within the interior of the vacuum envelope 41. This heat cage has one end seated in an annular recess 49 provided in the base 42 of the vacuum envelope 41 and is bonded therein by suitable means such as soldering or brazing. The lower extremity of the heat cage 48 is provided with a plurality of holes or openings 51 which are spaced circumferentially around the heat cage 48 and are provided to permit the escape of any cleaning agent which may be used during assembly and becomes entrapped between the cage 48 and the sleeve 43.

The heat cage 48 is formed of a suitable material such as a chromium copper in which the chromium content is approximately 1% by weight. The copper is provided with a chromium content so that it is possible to cause an oxide of chromium to be formed on the exterior surface of the same during heating of the same in an atmosphere of wet hydrogen. It has been found that this oxidation process provides a greening of the exterior surface caused by the formation of a chromium oxide coating on the exterior surface of the heat cage. This coating provides an excellent heat emission surface which substantially enhances the heat dissipating capabilities of the heat cage 48.

The heat cage 48 can be formed in a suitable manner such as by casting. Alternatively it can be formed from machined copper and chromium plated to provide a chromium oxide emissive coating. The heat cage 48 is provided with a window 53 which is in registration with the opening 28 provided in the cylindrical housing 22 through which the x-rays which are generated within the tube 21 can pass as hereinafter described.

A curved plate 56 (see FIG. 7) which is curved in one direction is formed of a suitable material such as beryllium. Beryllium is desirable because it has a low absorption coefficient for x-rays but provides protection for the stainless steel window portion 43*a* from damage by secondary electrons being emitted from within the tube 21.

The plate 56 which serves as an x-ray window is held in place over the openings 28 and 53 by suitable means such as brazing it to the heat cage 48. Alternatively the plate can be loosely held in a frame (not shown) secured between the sleeve 43 and the heat cage 48. By way of example the beryllium window can have a thickness of approximately 0.40 mils to protect a stainless steel wall 5 mils thick.

A shaft assembly 61 is rotatably mounted within the cylindrical housing 22 and the envelope 41 and extends through the holes 44 and 34. The shaft assembly 61 consists of a shaft 62 formed of a suitable material which is capable of withstanding high temperatures. For example a material called Hastalloy or also identified as Haynes No. 230 can be used.

The shaft 62 is hollow as shown and can be formed in a suitable manner such as by machining. It is provided with a thickened portion 62*a* which is intermediate the ends of the shaft. The thickened portion is provided with an annular seat 63 which abuts a shoulder 64. The shaft 62 is provided with relatively long thin-walled portions 62*b* and 62*c* on opposite ends of the thicker portion 62*a*. The portions 62*b* and 62*c* can have a suitable wall thickness as for example 0.020 to 0.025 inches. These thin-walled portions are provided to inhibit the travel of heat towards both extremities of the shaft.

The Hastalloy material from which the shaft 62 is formed has a high percentage of chromium in it as for example in the range of approximately 32% by weight. The shaft is heated up to a suitable temperature as for example approximately 1,100° C. in a wet hydrogen atmosphere to cause a chrome oxide coating to form on the shaft which has the greenish appearance This oxide coating on the exterior of the shaft 62 provides excellent heat emission from the shaft.

A solid ceramic coupling 66 is mounted on one end of the shaft 62. It is provided with metal Kovar collars 67 and 68 on opposite ends thereof. The metal collar 67 is secured to one end of the Hastalloy shaft 62 by suitable means such as brazing. The coupling 66 has a skirt portion 66*a* to enhance the voltage insulating capabilities of the part. The metal collar 68 at the other end of the coupling 66 is also secured by suitable means such as brazing to a cylindrical sleeve 71 of a suitable material such as stainless steel.

The sleeve 71 (see FIG. 5) serves as a rotor support and has a cylindrical squirrel cage rotor 72 mounted thereon and held in place by a circular plate or washer 73 formed of suitable material such as stainless steel. The plate 73 is secured to the rotor support sleeve 71 by suitable means such as screws 74. A drive pin 76 is carried by the outer extremity of the plate 73 and extends upwardly into the squirrel cage rotor 72. The squirrel cage rotor 72 is formed in a conventional manner as for example of alternating strips of copper and magnetic steel. The washer 73 can be utilized for balancing purposes for balancing one end of the shaft 62. This can be accomplished by removing the plate or washer 73 and shaving material from the same in appropriate locations to achieve the desired balance for the shaft assembly 61.

Means is provided within the envelope 41 for mounting the shaft assembly 61 for rotatable movement within the envelope in a direction in which the axis of rotation extends longitudinally of the envelope 41. Such means is provided for mounting one end of the shaft carrying the rotor 72 and consists of a rear ball bearing assembly 81 (see FIG. 5) having an outer race 82 which is mounted within and secured to the rotor support sleeve 71. The outer race 82 is adapted to rotate with the rotor support sleeve 71. The inner race 83 of the ball bearing assembly is held in a stationary position with respect to the envelope and is supported in such a manner so as to accommodate the expansion and retraction of the ball bearing assembly 81 during operation of the x-ray tube 21. A flanged bearing support member 84 extends into the inner race 83 and is secured to the inner race 83 by suitable means such as a collar 86 overlying a wave washer 87 engaging the inner race. The collar 86 is retained against the yieldable wave washer 87 by a pin 88 extending through the flanged bearing support member 84. The flanged bearing support member 84 is provided with a bore 91 which is adapted to receive a pin 92 that extends at right angles from a circular support plate 93. The pin 92 is provided with a flat 94 extending longitudinally of the same and disposed on one side of the pin which is adapted to engage the pin 88 extending substantially diametrically of the flanged bearing support member 84. This prevents rotation of the flanged bearing member 84 and the inner race 83 carried thereby.

A rotor housing 96 is provided for enclosing the rotor 72 within a vacuum-tight enclosure and also for providing support for the support plate 93 to prevent rotation of the same. This rotor housing 96 consists of a rotor sleeve 97 which has one end bonded in the hole 44 of the plate 42 by a suitable means such as brazing. The other end of the rotor sleeve 97 is closed off by rotor end plate 98 that is secured to the rotor sleeve 97 by suitable means such as brazing. The rotor sleeve 97 is provided with a thin wall portion 97*a* intermediate the ends of the same as for example having a thickness of approximately 12 mils to provide good magnetic coupling between the rotor and the stator. The support plate 93 is mounted in a fixed position within the rotor housing 96 by a suitable means such as a C-ring 98 seated in an annular recess 99 provided on the interior surface of the rotor sleeve 97. From the foregoing construction it can be seen that the interior of the rotor sleeve is in communication with the interior of the vacuum envelope 41.

Front bearing support means 101 (see FIG. 8) is provided for mounting the other end of the shaft 62 and consists of a cylindrical cup-shaped front bearing housing 102 which is seated within the front extremity of the shaft 62. The outer race 103 of a front ball bearing assembly 104 is seated within the front bearing housing 102 for rotation therewith. The outer race 103 of the ball bearing assembly 104 is retained within the cup-shaped front bearing housing 102 by suitable means such as a C-ring 106. Yieldable spring means is provided in the form of a helical coil spring 107 formed of a suitable high temperature material such as stainless steel or Inconel which has one end engaging the front bearing housing 102 and has the other end engaging a washer 108. The washer 108 engages a push-rod pin 109 which is mounted in a push-rod 111. The push-rod 111 is slidably mounted in the front bearing housing 102 and has its rear distal extremity adapted to engage a push disc 112 slidably mounted within the shaft 62. The push disc 112 (see FIG. 6) is provided with a dished recess 113 which is adapted to receive the rear end of the push-rod 111. The push disc 112 engages a clamping pin 116 which extends through elongated slots 117 provided in the shaft 62. The longer axes of the slots 117 extend in a direction axially of the shaft 62. The outer extremities of the clamping pin 116 are seated in slots 118 provided on the front surface of an anode washer 119. The anode washer 119 engages an anode plate 121 which is mounted on the annular seat 63 of the shaft 62 and is seated against the shoulder 64. The anode washer 119 is yieldably retained in engagement with the shoulder 64 by the pin 116 which is yieldably urged rearwardly by the spring 107. From the construction hereinbefore described it can be seen that the spring 107 serves to yieldably urge the anode plate 121 towards the shoulder 64 provided on the shaft 62.

The anode plate 121 is provided with a special surface 122 formed of rhenium tungsten material of a conventional type. It can be seen that the surface 122 is disposed at an angle and is positioned so that electrons striking the same will form x-rays that will pass through the opening 28. A large annular graphite block 126 is carried by the anode plate 121 and serves as a large heat sink as hereinafter described.

Figure 8:
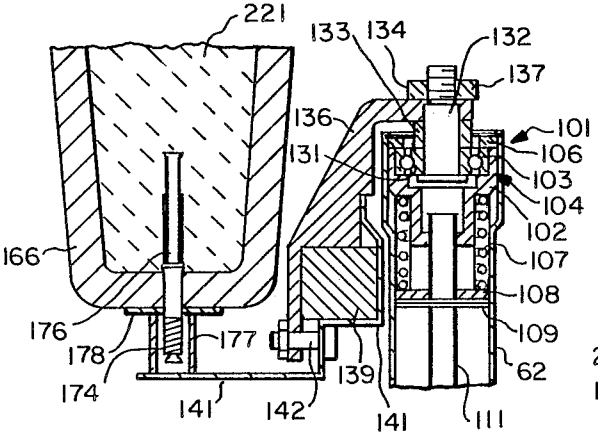
FIG. 8 is an enlarged cross-sectional view of the anode feedthrough and the front bearing construction.

The front ball bearing assembly 104 is provided with an inner race 131 (see FIG. 8). A front bearing support member 132 is mounted in the inner race. A spacer 133 is mounted on the bearing support member 132 and engages the inner race 131. The bearing support member 132 also extends through a hole 134 provided in a bearing support bracket 136 and is retained in the hole 134 by a nut 137 threaded onto the front bearing support member 132 to retain the inner race of the ball bearing assembly in a stationary or non-rotatable position while retaining it in a fixed position within the tube envelope 41. The L-shaped bracket 136 is mounted upon a cross-bar 139 formed of a suitable high temperature non-conducting insulating material such as silicon nitride. The bracket 136 is retained on the bar 139 by a spring clamp 141 secured to the bracket 136 by a suitable means such as a bolt 142. The bar 139 extends across the vacuum envelope 41 and is mounted upon a pair of support brackets (not shown) on opposite ends of the same which support the same on a circular cross plate 146 (see FIG. 4). The brackets (not shown) which carry the bar 139 and the plate 146 are formed of a suitable metal such as stainless steel. The cross plate 146 overlies a cage cover plate 147 formed of the same copper material as the copper heat cage 48. The cover plate 147 overlies an annular flange 148 provided on the cage 48. Means is provided for establishing intimate contact between the cover plate 147 and the flange 148 of the cage 48 and includes a C-ring 151 seated in annular recess 152 in the cage 48. The C-ring 151 captures the outer circumferential surface of the cross plate 146. The cross plate 146 carries a plurality of screws 153 near its outer margin which are adapted to engage the cover plate 147. It can be seen by adjusting the screws 153 large forces can be provided on the cover plate 147 to form a n intimate contact with the flange 148 when the cross plate 146 is in engagement with the C-ring 151.

The cover plate 147 and the cross plate 146 are provided with aligned openings 154 and 156 through which the shaft assembly 61 extends and on which the anode plate 121 is mounted. A major amount of the heat given off by the anode plate 121 is absorbed by the cross plates 146 and 147 to protect the front bearing assembly 104 from high heat. The heat from the cross plates 146 and 147 enters the heat cage 48 which dissipates the heat through the lead liner 46 and the finned cylindrical housing 22.

A circular mounting ring 161 is mounted on the end of the sleeve 43 and is of greater thickness than sleeve 43. The mounting ring 161 is secured to the sleeve 43 by suitable means such as brazing. A circular terminal or top mounting plate 162 is mounted upon the mounting ring 161. The mounting ring 161 is formed of a suitable material such as stainless steel material hereinbefore described. The plate 162 is formed of a suitable material such as stainless steel also. To augment the seal which is provided between the mounting ring 161 and the plate 162, a strip 163 of a suitable material such as stainless steel is welded to the plate 162 and to the mounting ring 163. When it is desired to remove this seal, this stainless steel ring 163 can be removed by machining and then the top cover plate 162 can be removed to facilitate the repair of the tube when necessary.

A cup-shaped ceramic anode feedthrough 166 and a cup-shaped ceramic cathode feedthrough 167 are mounted in holes 168 and 169 provided in the cover plate 162. The feedthroughs 166 and 167 are of conventional construction and are provided with Kovar metal skirts 171 which are welded to the stainless steel cover plate 162 to provide vacuum-tight seals. The anode feedthrough 166 is provided with a single external female terminal 174 which receives an internal male banana-type plug 176 mounted within the feedthrough 166. The terminal 174 engages the metal spring clamp 141. The clamp 141 carries a coil spring 177 through which the terminal 174 extends. The spring 177 makes electrical contact with the plate 178 which is electrically connected to the terminal 174. The clamp 141 makes electrical contact to the anode shaft 62 through the bracket 196 and through the front ball bearing assembly 104.

The cathode feedthrough 167 is provided with five female terminals with one central grid terminal 181 and one common terminal 182 and three filament terminals 183 disposed around the central terminal 181. Corresponding male banana-type plugs 184 are mounted internally of the feedthrough 167 in the female terminals 181, 182 and 183.

Figure 9:
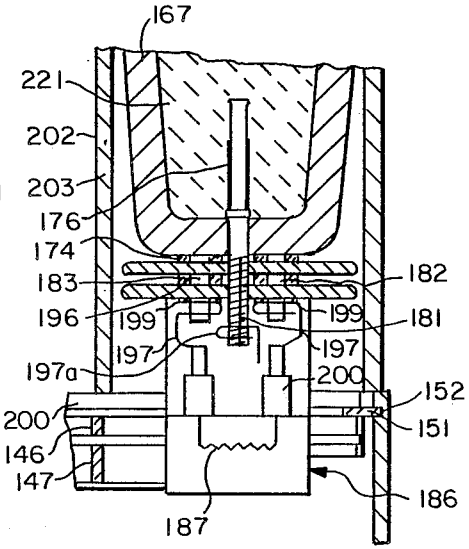
FIG. 9 is a cross-sectional view showing the cathode feedthrough and the cathode assembly.

A conventional cathode assembly 186 is provided which has three filaments 187. One end of each of the filaments 187 is connected to one of the filament terminals 183 and the other end is connected to the common terminal 182. One of the filaments 187 is shown in FIG. 9. The cathode assembly 186 is carried by a pair of screws 188 (see FIG. 10) which are threaded into the cathode assembly 186. The screws 188 are carried by a quartz disc 191 which is provided as a subassembly 192 and is mounted upon the terminals 181, 182 and 183 of the cathode feedthrough 167. Lock nuts 189 are provided on the screws 188 and serve to clamp the cathode assembly 186 onto the screws. Lock nuts 190 are also provided on these screws and serve to secure the screws to the quartz disc 191. This subassembly 192 can be supported in a suitable manner. For example, as shown in particularly FIGS. 9 and 10, a second quartz disc 193 is provided which is also mounted upon the terminals 181, 182 and 183 and engages a metal washer 194 mounted on the terminals and disposed between the disc 193 and the lower extremity of the cathode feedthrough 167. Additional washers 196 are mounted on the same terminals and serve to space the quartz disc 191 from disc 193. Spring-like contact elements 197 in the form of metallic strips of a suitable material such as nickel are provided. These strips 197 are provided with U-shaped extremities 197*a* which are secured to the outer extremities of the terminals 181, 182 and 183 by C-rings 198. Coil springs 199 are also mounted on the terminals 181, 182 and 183 between the U-shaped extremities 197*a*. The springs 199 serve two functions, one to yieldably urge the quartz disc 191 in a direction toward the feedthrough terminal 167 and the other to ensure that the spring-like strips 197 make good electrical contact with the terminals. The other ends of the strips 197 are secured to posts 200 provided on the cathode assembly 186.

Additional means is provided for insulating the cathode assembly from heat and consists of an outer sleeve 202 of stainless steel surrounding a quartz tube 203. The upper extremity of the stainless steel sleeve 202 is secured to the cover plate 162 by bringing it to the lower extremity of the skirt 171 of the cathode feedthrough 167. The sleeve 202 can be of suitable thickness such as 0.005 inch. As can be seen particularly in FIG. 4, the cathode assembly 186 extends through holes 206 and 207 provided in the plates 147 and 146. Electrons emitted from the filament 27 are directed onto the rhenium tungsten surface 132 to create x-rays which travel through the window 28. The cover plate 162 is provided with a pinch-off tube 211 which can be pinched off after the vacuum envelope 41 has been evacuated. A cover 212 is provided for covering the pinch-off tube 211. A viewing window (not shown) is also provided in the cover plate 212.

A termination is provided for the x-ray tube which conforms to present federal termination standards for x-ray tubes. Thus there has been provided an end cap 216 formed of a suitable material such as lead which seats over one extremity of the cylindrical housing 22. The end cap 216 is provided with a planar surface 217 in which two receptacles 218 and 219 are provided of a conventional type. The space within end cap 216 not required for the receptacles 218 and 219 and the space within the anode and cathode feedthroughs 166 and 167 can be filled with a suitable insulating material 221 such as an RTV silicon rubber. Cables 222 and 223 with appropriate terminations are mounted in the receptacles 218 and 219. The cables 222 and 223 are adapted to be connected to a suitable high voltage source.

Suitable means is provided for securing the end cap 216 (see FIGS. 1 and 4) to the cylindrical housing 22 to ensure that there is no leakage of x-rays from within the tube. Such means consists of hook-like elements 226 formed of stainless steel having one hooklike portion 226*a* secured to the plate 162 and which extend outwardly between the interior of the lower extremity of the end cap 216 and the exterior of the cylindrical housing 22. The hook-like elements 226 also have hook-like portions 226*b* which are connected to hook-like portions 227*a* of yieldable means in the form of springs 227 which extend longitudinally of the cylindrical housing between the fins 31 (see FIG. 1). Hook-like elements 227*b* provided on the other ends of the springs 227 are secured to the other end of the housing 22 by connection to the trunnion interface 32

A stator assembly 231 is provided as a part of the squirrel cage motor for the x-ray tube. It is of conventional construction and is provided with a laminated core 232 which carries windings 233. Means is provided for securing the stator assembly 231 to the cylindrical housing 22 and consists of threaded bushings 236 which are secured to the core by suitable means such as welding. Screws 237 are threaded into the threaded bushings 236 and extend inwardly to engage the bottom side of the housing 22. Springs 238 are provided on the screws between the bushings 236 and a triangular plate 239. Means is provided for securing the plate 239 to the housing 22 and consists of springs 241 which have one end of the same hooked to the corners of the triangular plate 239 and have the other end secured to pins 242 carried by the housing 22. A fan assembly 246 is mounted on the plate 239 and is provided with a centrally disposed motor 247 which drives a fan blade 248.

Suitable means is provided for enclosing the fan assembly 247 and the rear extremity of the finned housing 22 and includes a cylindrical grill 251 and an end cover grill 252. The cylindrical grill 251 and the end cover grill 252 can be spot welded to each other and secured to the housing 22 by suitable means such as springs (not shown).

Means is provided for supplying power to the stator assembly 231 of the squirrel cage motor and to the fan assembly 246 and consists of a terminal block 253 secured to the housing 22 (see FIG. 1) and connected to a cable 254 disposed longitudinally of the tube 21 between two of the finds 31 and connected to a connector 256 which is adapted to be connected to a suitable source of power such as 110 volts 60 cycle A.C.

Operation and use of the air-cooled metal ceramic x-ray tube construction hereinbefore described may now be briefly described as follows. Let it be assumed that the x-ray tube 22 has been mounted in an x-ray apparatus and connected to suitable power supplies. Thus the cables 222 and 223 would be connected into the high power supply to provide the desired high voltages to the x-ray tube 22. In addition, power is connected to the connector 256 connected to the fan motor 246 and to the alternating current squirrel cage motor comprised of the rotor 72 and the stator assembly 231.

Electrons generated by the selected heated filament 187 of the cathode assembly 186 are subjected to a high voltage placed between the cathode and the anode and are rapidly accelerated to travel in the evacuated envelope 41 toward the surface 122 of the rotating anode plate 121 as indicated by the rays 271. These electrons upon striking the inclined surface 122 generate x-rays indicated by the rays 272 which are propagated in a direction at substantially right angles to the beam 271 and pass through the opening 153 through the beryllium window 56 and through the thinned down stainless steel window portion 43*a* provided in the vacuum envelope 41. The x-rays then pass through window 47 provided in the lead liner 46 and through the opening 28 provided in the housing 22 as shown particularly in FIG. 7. The copious amounts of heat which are generated at the time the x-rays are generated are dissipated into the anode plate 121 which dissipates its heat into the large graphite heat sink 126. The heat which is radiated from the graphite heat sink 126 and the anode plate 121 is collected by the highly conductive relatively thick walls of the heat cage 48 which surrounds the anode plate 121. As hereinbefore explained, the heat cage 48 is thermally extended to the rear of the tube and is joined to the base 42 to provide for an efficient heat exchange with the forced air which is being directed from the rear of the tube between the fins 31*a* and upwardly towards the base 22*a* of the cylindrical housing 22 as indicated by the arrows 276. As explained previously, an excellent heat transfer interface is provided between the base 22*a* of the housing, the lead liner 46 and the base 42 of the vacuum envelope 41 and also forming the base for the copper heat cage 48. For this reason a major portion of the heat dissipated by the anode is dissipated from the tube before it can reach the thin walls of the tube, the ceramic connectors and the bearings provided for mounting the shaft. As hereinbefore explained, particular design features have been incorporated in the x-ray tube to inhibit the transfer of heat to the double-ended bearing construction. Thus as explained previously, the shaft 62 is provided with very thin walled portions on opposite sides of the location at which the anode plate 121 is mounted on the shaft 62 to substantially inhibit the transfer of heat along the shaft towards the bearings mounted on each end of the shaft. By utilizing a construction of this type, it is possible to provide an x-ray tube which can be air-cooled and which does not require the use of more sophisticated oil cooling techniques and the like.

From the foregoing description, it can be seen that the high voltage connectors which are utilized in the x-ray tube are fully integrated into the tube permitting the high voltage to be supplied directly to the tube. The shaft 62 is mounted upon two bearings which are located on opposite sides of the anode plate 121 at the remote ends of the tube facilitating shielding of the bearings from the anode heat radiation. The double-ended bearing construction utilized is facilitated by the metal ceramic design incorporated into the tube. The construction of the tube has made it possible to increase bearing life dramatically. The bearing construction makes possible the support of heavier anodes thereby making possible higher heat storage capabilities. The construction also makes possible higher anode heat dissipation capabilities because of the thermal protection provided for the bearings. The double-ended bearing support provided for the shaft reduces mechanical stresses on the shaft and reduces the likelihood of the bending of the shaft when it is subjected to the extreme heat encountered within the x-ray tube. Also because of the bearing construction provided it is possible to provide improved mechanical stability, and greatly reduced likelihood of vibrations developing during the tube life. Higher rotational speeds are permissible with the use of the shaft disclosed with its bearing supports making it possible the use of higher power or smaller focal spots where size is important to provide a reduction in anode size for mobile applications.

As hereinbefore described, the rear end of the shaft 62 is provided with high strength ceramic coupling 66 which provides high voltage insulation between the anode and the rotor and permits the rotor to be operated at the same ground potential as the stator. For that reason, short distances can be utilized to establish an intimate electromagnetic coupling between the rotor and the stator of the motor while still maintaining the rotor in a vacuum. This construction makes it possible to utilize a low cost, low power electrical supply.

The x-ray tube construction of the present invention is particularly adapted for use in newly manufactured x-ray equipment. However it is constructed in such a manner that it can be utilized to retrofit existing x-ray equipment. Because of the construction utilized in the x-ray tube, there is a sharply reduced service and replacement expense associated with the tube. The tube is plug compatible with the existing CT and conventional x-ray equipment. The construction of the tube utilizing a metal ceramic construction with air cooling makes it possible to eliminate the use of expensive oil cooling. The x-ray tube construction of the present invention can have a weight ranging from approximately 30 to 45 pounds. It can have a length ranging from 10 to 15 inches with a diameter of approximately 6.5 inches. It can be operated at voltages up to 150 kilovolts. Rotor speeds of 1,200 rpm with 1 to 2 second acceleration and deceleration can be accomplished. The anode can be approximately 4.250 inches in diameter and has a heat storage capacity which can range from 400,000 to 2,000,000 heat units. The construction is capable of dissipating 2,000 to 3,000 watts of energy. The construction of the tube is such that the external temperature of the housing should not exceed 140° Fahrenheit. Excellent protection against radiation is provided. The high voltage termination utilized meets the federal standards.

Figure 12:
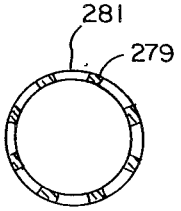
FIG. 12 is a partial cross-sectional view taken along the line 12—12 of FIG. 11.
Figure 11:
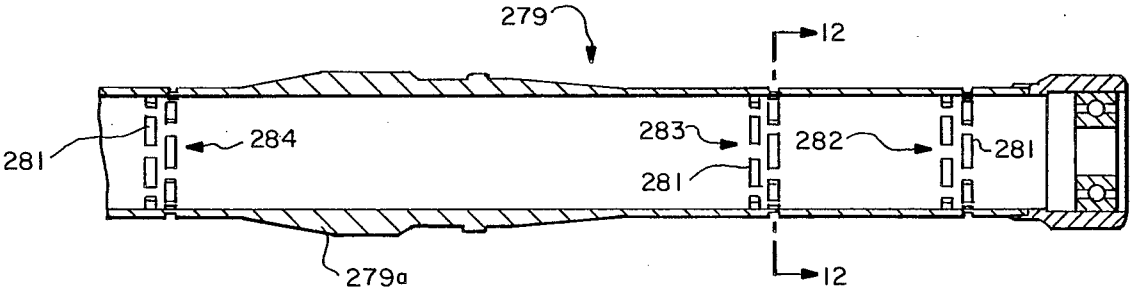
FIG. 11 is a cross-sectional view of another embodiment of a shaft for the tube construction shown in FIG. 1.

In FIGS. 11 and 12 there is shown a modified shaft 279 corresponding to the shaft 62 hereinbefore described. The shaft 279 differs from the shaft 62 in that it is provided with a plurality of rectangular slots 281 arranged in pairs or two spaced apart parallel rows with the slots in one row overlapping the slots in the other row. The major axis of each of the slots extends in a direction perpendicular to the longitudinal axis of the shaft 62*a*. One or more pairs of rows of slots can be provided on the shaft on opposite ends of the shaft 279 and spaced away from the thicker walled portion 279*a*. Thus there are provided two spaced apart pairs 282 and 283 on the front end of the shaft 279 and a single pair 284 on the rear end of the shaft 279. The slots 281 serve to inhibit heat transfer longitudinally of the shaft by providing less mass for the heat to travel through and also by providing a staggered circuitous path for heat to flow through the pairs of rows.

Means is provided in the receptacles 218 and 219 (see FIG. 3) to make it possible for the receptacles to accommodate various types of federal terminations. Thus there has been provided in each of the receptacles 218 and 219 circular plates 286 (see FIG. 4) of a suitable insulating material such as RTV silicon rubber in which there has been provided five male banana-type terminals 287–291. The terminal 287 is the grid terminal, the terminal 288 is the common terminal and the terminals 289, 290 and 291 are the three filament terminals, respectively, the small focus, medium focus and large focus respectively. A registration notch 292 is provided in each of the receptacles 218 and 219.

A plurality of inserts 293, 294, 295 and 296 (see FIG. 13A–13D) are provided which are adapted to be placed within receptacles 218 and 219 and mate with the male type terminals 287–291 provided therein. The inserts 293–296 are formed of circular plates 297 of a suitable insulating material such as an RTV silicon rubber.

The inserts 293–296 are provided with a plurality of smaller holes 299, 300, 301, 302 and 303. All but one in each insert have metal female receptacles (not shown) therein and are adapted to mate with the male banana-type terminals 287–391. The receptacle 299 can be the grid receptacle, the receptacle 300 the common receptacle, and receptacles 301, 302 and 303 the small, medium and large filament receptacles respectively. Larger openings 304–308 are provided which also have metal female receptacles therein (not shown). The receptacle 304 serves as the grid receptacle, 305 as the common receptacle, and receptacles 306 and 307 as the filament receptacles. The electrical connections between the inserts provided in the receptacles 299–307 are shown in FIGS. 13A–13D. In this manner, the insert 293 serves to accommodate a three pole federal high voltage terminal which provides supply voltage for the large and the medium focus of the three foci in the x-ray tube, whereas the insert 294 serves to accommodate a four pole federal high voltage terminal which provides supply voltages for the grid, the large and the medium focus of the three foci in the x-ray tube. The insert 295 accommodates a three pole federal terminal to supply the large and the small filaments of the three filaments in the x-ray tube whereas the insert 296 accommodates a four pole federal high voltage terminal to supply voltage to the grid, the large and the small focal spots provided by the three filaments in the x-ray tube. In those terminals where no grid connection is provided, the grid receptacle is connected to the common receptacle by a conductor 308 embedded in the insulating material of the insert so that the common and grid receptacles are interconnected.

A central threaded bore 309 is provided for receiving a threaded service tool for removing and inserting the inserts 293–296.

In this way it can be seen that by utilizing the inserts 293–296 four different federal terminations can be utilized with the x-ray tube. This makes it possible for the user to establish which federal termination the user desires. It also makes it possible for a user to make a change in the field from one federal termination to another.

An observation window 406 (see FIG. 1) is provided in the end cap 351. It is formed of a rod 407 of lead glass to permit viewing during operation of the tube.

In addition a four pole terminal adapter can accommodate all three focal spots provided by the three filaments of the x-ray tube if no grid voltage supply is required.

Another embodiment of the air cooled metal ceramic x-ray tube construction incorporating the present invention is shown in FIGS. 14–20. The x-ray tube 310 therein shown consists of many parts which are identical or substantially identical to the x-ray tube 21 hereinbefore described and are given the appropriate corresponding numerals. One of the principal differences between the x-ray tube 310 and the x-ray tube 21 is the use of a columbium shaft assembly 311 in place of the Hastalloy shaft assembly 61. The shaft 311 consists of a hollow thin-walled shaft 312 formed of a suitable high temperature material such as columbium. Such a shaft should be able to withstand temperatures up to 1700° C. whereas such a shaft formed of Hastalloy should be able to withstand a temperature of approximately 1100° C. The shaft 312 can have a suitable wall thickness ranging from 0.020 to 0.040 inches and preferably a thickness of approximately 0.030 inch. One end of the shaft 312 is brazed to a metal collar 313 formed of a suitable material such as columbium which is brazed to the shaft 312 and which is mounted on one end of the ceramic coupling 66.

A large cylindrical heat sink 316 is mounted on the front end of the shaft 312. The heat sink 316 is formed of a suitable material such as stainless steel having a chromium content so that an emissive coating of chromium oxide is formed on the same when heated in a wet hydrogen atmosphere as hereinbefore described. The heat sink 316 is provided with a large central bore 317 extending longitudinally the length thereof. The bore 317 is of a size which is substantially greater than the external diameter of the shaft 312 so that there is provided an annular space 318 between the shaft 312 and the heat sink 316. The heat sink 316 is provided with a well 319 in the front end thereof which is adapted to receive the outer race 103 of the ball bearing assembly 104. The heat sink 316 is retained on the shaft 312 by suitable means such as a pin 321 extending diametrically of the shaft 312. The cylindrical heat sink 316 is provided with three circumferentially spaced threaded bores 323 in which there are mounted set screws 324. The set screws 324 are adjustable within the bores and are used for balancing the heat sink 316 as well as the metal anode 326 formed of a suitable material such as molybdenum which carries an inclined annular surface 327 formed of rhenium and tungsten that serves as the target for the electron beam.

Figure 16:
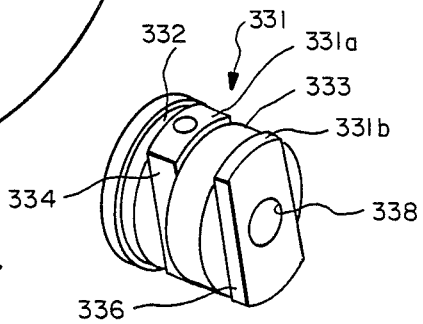
FIG. 16 is an isometric view of the coupling for mounting the anode plate on the shaft as shown in FIG. 13.
Figure 18:
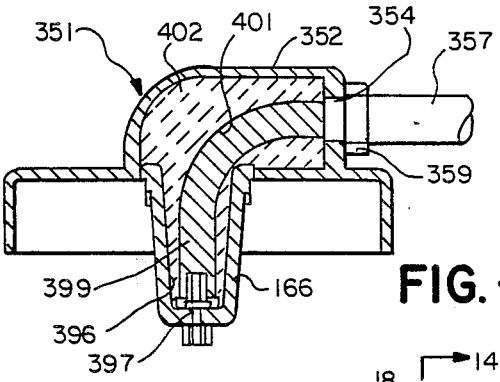
FIG. 18 is a cross-sectional view taken along the line 18—18 of FIG. 17.

Means is provided for mounting the anode plate 326 on the shaft 312 and consists of a coupling 331. An isometric view of the coupling 331 is shown in FIG. 16. It can be formed from a cylindrical block of columbium in which there has been machined annular recesses 332 and 333. A pair of spaced parallel flats 334 are formed on the portion **331*a* between the annular recesses 332 and 333. Similarly spaced flats 336 are formed on the portion 331*b* on the other side of the recess 333. A bore 338 has been provided extending from the front side of the coupling 331 and opens into a larger bore 339 (see FIG. 14) extending through the other end of the coupling 331. The bore 339 as shown in FIG. 14 is of a size so that it is substantially larger than the shaft 312 so as to provide a substantial space between the shaft and the interior of the coupling 331**.

The anode plate 326 is constructed in a manner so as to be able to receive the coupling 331. It is provided with a central bore 341. The bore 341 opens into four substantially semicircular lobes 342 which are spaced 90° apart (see FIG. 16). These lobes 342 facilitate the insertion of the coupling into the anode plate. The coupling 331 is introduced through the rear side with the flats 334 and 336 in alignment with two of the diametrically opposed lobes 342 so that it extends through the anode plate. After the coupling 331 has been inserted through the anode plate, washers 346 and 347 are inserted The coupling 331 is held in place by suitable means such as a washer 346 which engages the anode plate 336 and a plate 347 which is rotated in position over the portion 331*b* of the coupling and so it underlies the portion 331*b* to lock the anode plate onto the coupling 331. The coupling 331 can be secured to the shaft 312 in a suitable manner such as welding.

Figure 14:
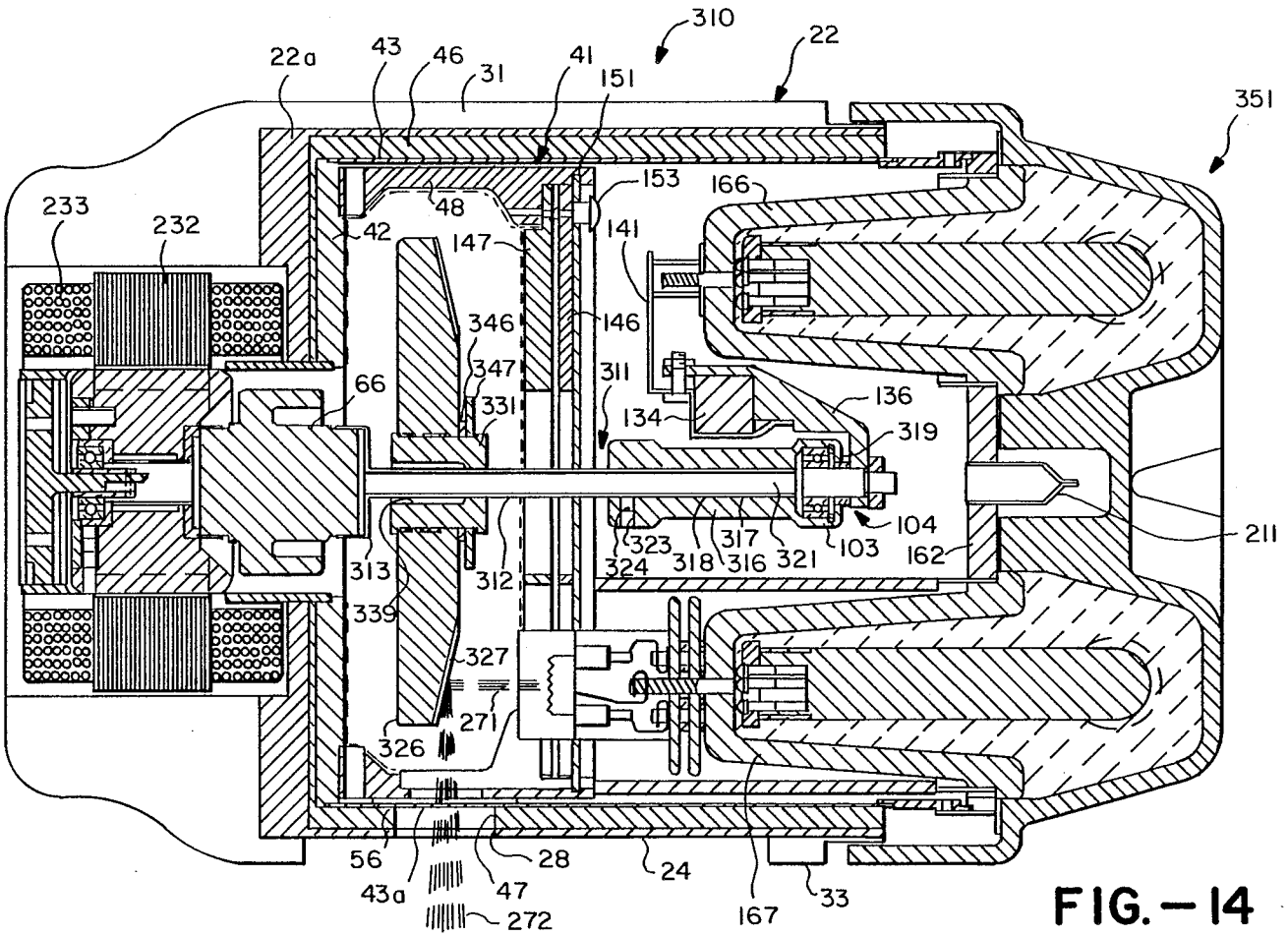
FIG. 14 is a cross-sectional view similar to that shown in FIG. 3 showing another embodiment of an x-ray tube construction incorporating the present invention and taken along the line 14—14 of FIG. 17.
Figure 15:
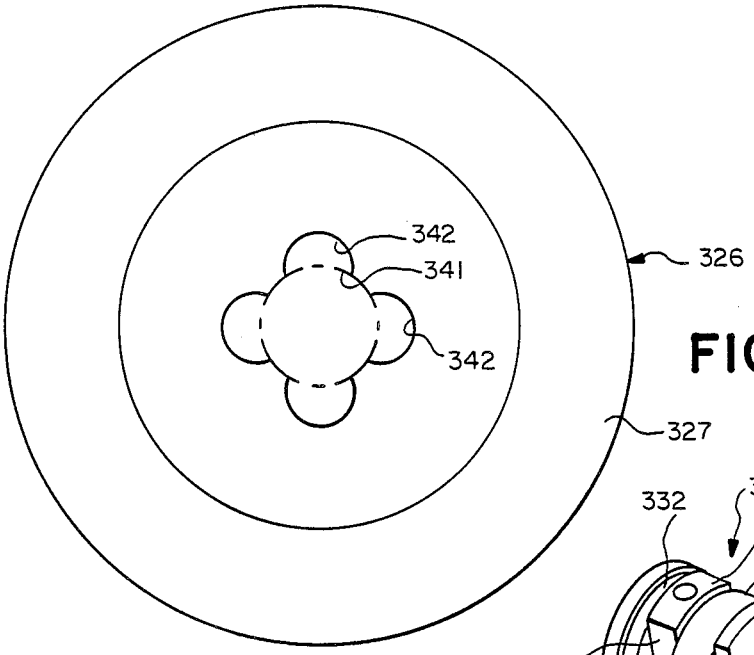
FIG. 15 is a top plan view of the anode plate shown in FIG. 14.

The x-ray tube construction which is shown in FIG. 14 is a compact version and is for use when lower output requirements can be tolerated. In order to make it compact, the fan assembly 246 provided in the previous embodiment has been omitted so that the cooling relied upon for the tube occurs through the transfer of heat to ambient air without the necessity of forced air cooling. This type of tube is limited in output but can serve many high performance applications.

Figure 20:
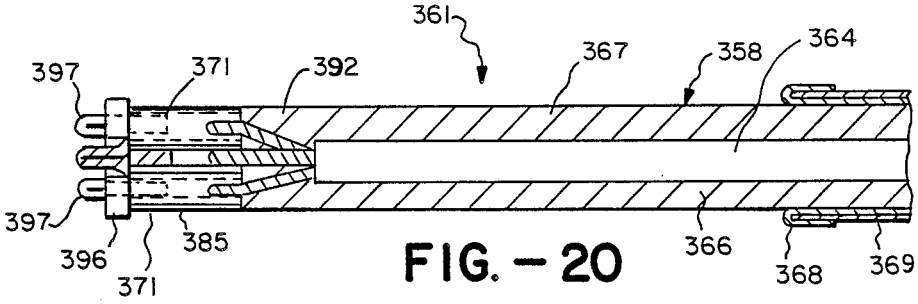
FIG. 20 is a cross-sectional view of a cable terminal made with the syringe shown in FIG. 19.
Figure 13A:
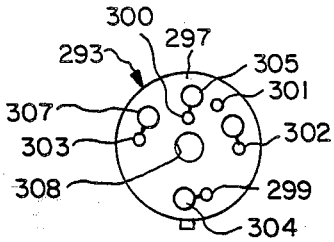
FIGS. 13A, 13B, 13C and 13D are plan views of four different inserts used to accommodate four different federal terminations in the high voltage receptacles in the x-ray tube construction.
Figure 13B:
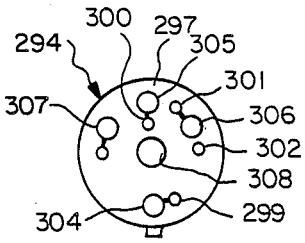
Figure 13C:
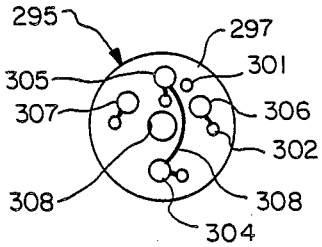
Figure 13D:
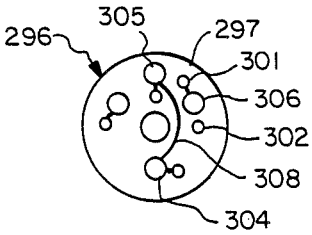
Figure 17:
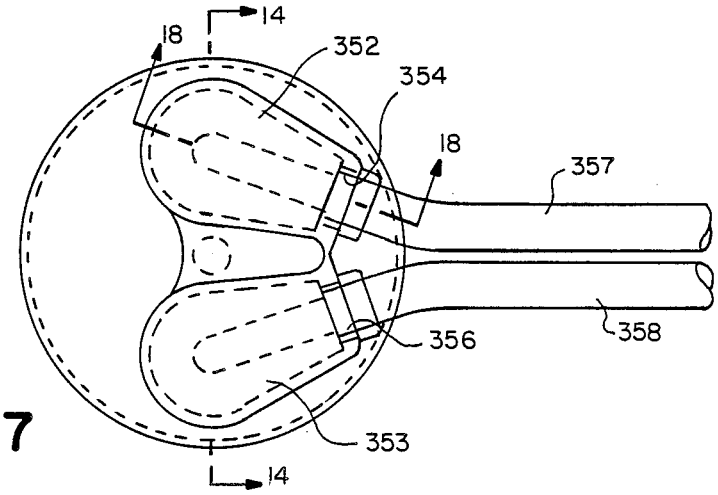
FIG. 17 is a top plan view of the end cap shown in FIG. 14.

A special termination terminal has been provided for the tube 310 and consists of an end cap 351 formed of lead. The end cap 351 can be held in place in the same manner as the end cap 216 in the previous embodiment. The end cap 351 is provided with a pair of L-shaped integral protrusions 352 and 353 (see FIGS. 17 and 18) which are provided with openings 354 and 356 through which high voltage cables 357 and 358 extend. Collars 359 are mounted on the cables 357 and 358 adjacent the openings 354 and 356 in the protrusions 352 and 353. The cables 357 and 358 are provided with special termination terminals 361, one of which is shown in FIG. 20. The terminals are of a type which can be manufactured in the field when that necessity arises. The cable shown in FIG. 17 is of a conventional type and consists of conductors 364 formed of a suitable material such as copper which are enclosed within a sheath 366 of conducting rubber to minimize corona discharge. The sheath 366 is enclosed in EPR rubber 367 to provide the termination terminal 361. The cables are also enclosed with an additional braided sheath 368 covered by a vinyl sheath 369.

Figure 19:
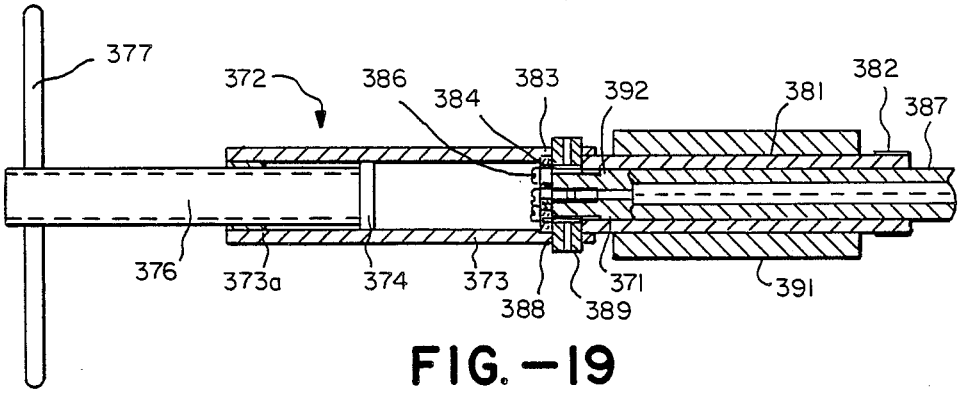
FIG. 19 is a cross-sectional view of a syringe showing the same used for making a cable terminal.

In preparation of a special terminal 361, the ends of the conductors 364 are stripped clean and thereafter female threaded fittings 371 are crimped onto the conductors. A syringe 372 of the type shown in FIG. 19 is then utilized to place vulcanized rubber around the fittings 371. The syringe 372 consists of a cylinder 373 formed of suitable material such as aluminum in which a piston 374 is slidably mounted. The piston is carried by a piston rod 376 which is threaded into a threaded portion 373*a* provided on the proximal extremity of the cylinder 373. A handle 377 is mounted in the piston rod and is provided for rotating the piston rod so that the piston 374 can be advanced and retracted. The syringe 372 is adapted to be utilized in connection with a cylindrical split mold 381 formed of a suitable material such as aluminum which is adapted to fit over the proximal extremity of the cable 358 and be secured thereto by a hose clamp 382. A conductive rubber sleeve 385 is placed in the mold 381 near the proximal extremity thereof. A circular plate 383 then is mounted on the other end of the member 381 and is secured to the fittings 371 by screws 384. The plate 383 is provided with additional holes 386 through which an insulating material such as an EPR silicon rubber can be extruded. The member 381 with the plate 383 secured thereto is adapted to be inserted into an annular recess 388 provided in the distal extremity of the cylinder 373 and is retained therein by bushings 389 extending through the cylinder 373 and extending through into the cylindrical member 381 to retain the member 381 connected to the cylinder 373. After the EPR silicon rubber has been introduced into the cylinder 373, the piston 374 can be actuated to force the silicon rubber into the member 381 to fill the space between the fittings with the silicon rubber. After this has been accomplished a heater 391 is placed around the mold formed by the split casing 381 and heat is applied to the mold to cure the EPR silicon rubber to vulcanize the same about the fittings 371 to provide a vulcanized rubber region 392 at the end of the cable 358.

After appropriate heat cured vulcanization, the bushings 389 are removed and the syringe 372 is separated from the casing or mold 381. The heater 391 is removed and thereafter the split casing 381. The screws 384 are then removed as is the plate 383. Thereafter, another plate 396 formed of an insulating material is provided and banana type terminals 397 are threaded into the fittings 371 to hold the plate 396 in place to complete the terminal 361 with the cable 358. The cable 357 can be provided with a similar terminal 399 (see FIG. 18). The terminal 399 can be inserted into the opening 354 in cap 351. The terminal 399 is bent through approximately 90° by being pushed through a curved passage 401 which has previously been formed within the end cap 351 by RTV silicon rubber 402 therein. The curved passage makes it possible to direct the cable terminal 399 so that the banana plug fitting 397 carried thereby can be pushed into the female receptacle carried by the feedthrough 166.

In this way it can be seen that in the event of damage of a high voltage cable, the cable can be readily repaired by cutting off the damaged portion and building a new terminal on the same in the field and thereafter inserting the terminal into the end cap.

The operation and use of the x-ray tube shown in FIG. 14 is substantially identical to that hereinbefore described. However, the tube is more compact and lighter in weight than the x-ray tube hereinbefore previously described. It is able to withstand the high temperature encountered without forced air cooling.

Figure 21:
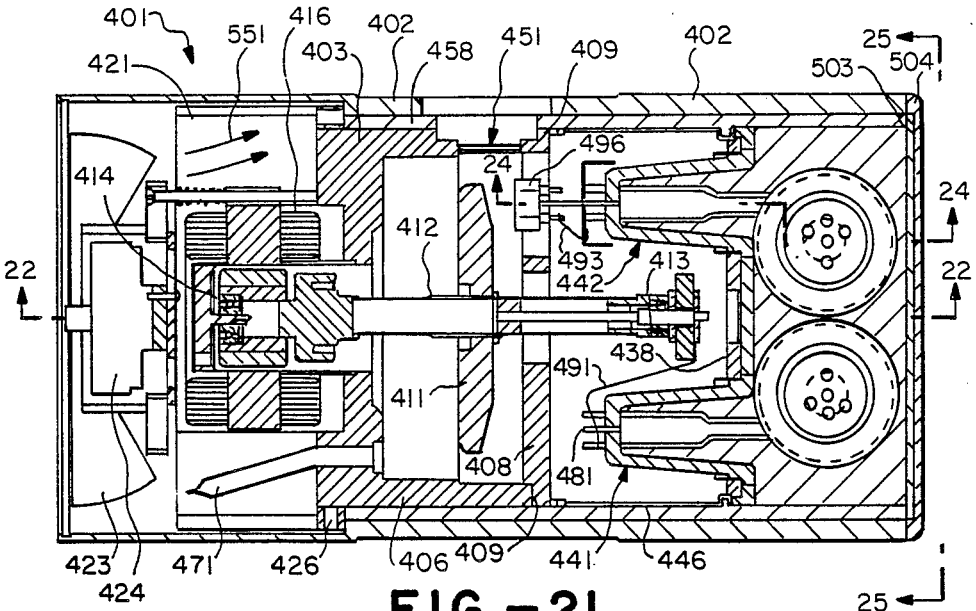
FIG. 21 is a side elevational view in cross section of another embodiment of an air-cooled metal ceramic x-ray tube construction incorporating the present invention and utilizing a single wall construction.
Figure 22:
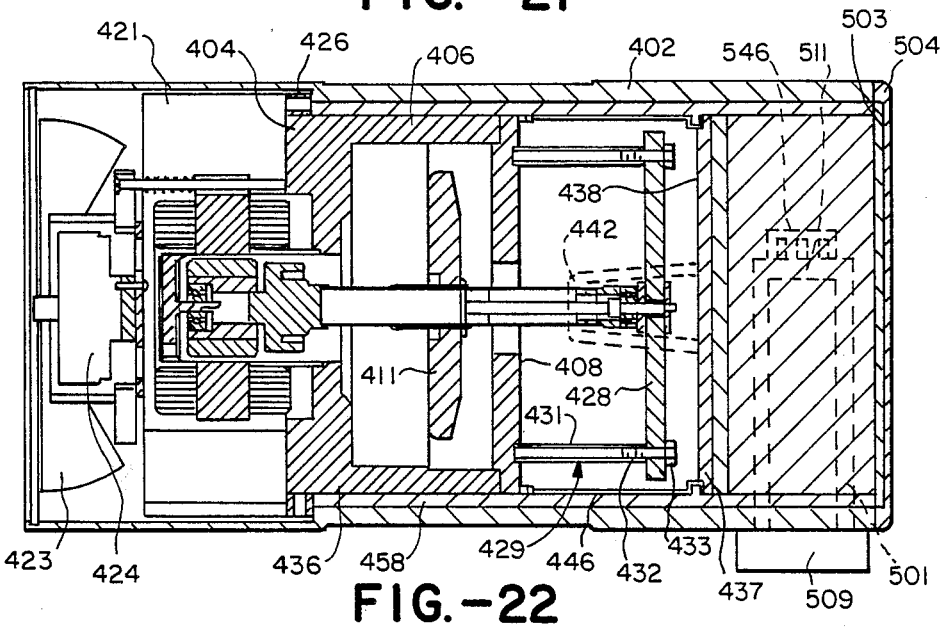
FIG. 22 is a cross sectional view taken along the line 22—22 of FIG. 21.

The x-ray tube construction 401 shown in FIGS. 21 and 22 is in many respects similar to that hereinbefore described in connection with the previous embodiments. Thus it is comprised of a cylindrical aluminum housing 402. A heat cage 403 is part of the vacuum tube envelope mounted within the housing 402 and is formed of a suitable material such as copper. The heat cage 403 is relatively massive and is provided with a bottom or end wall 404 and a cylindrical side wall 406. As shown, the heat cage 403 is formed as one piece. However, it should be appreciated that the cylindrical side wall 406 can be provided as one piece and the bottom wall 404 as another piece and the two pieces joined together by suitable means such as electron beam welding or brazing. A cross lid 408 also formed of a suitable material such as copper serves as another end wall and is bonded to the cylindrical side wall 406 by suitable means such as an electron beam weld indicated by the line 409.

An anode 411 of the type hereinbefore described is mounted within the heat cage 403 and is carried by a shaft 412 supported by a front bearing assembly 413 and a rear bearing assembly 414 of the type hereinbefore described. A squirrel cage motor 416 is provided for driving the shaft 412 and the anode 411 carried thereby.

The heat cage is provided with a plurality (50 to 200 and preferably approximately 100) of flat copper fins 421 which are secured to the end plate or bottom wall 404 of the heat cage 403 by suitable means such as brazing. The fins can be of a suitable size such as, for example, 0.010 to 0.100 and preferably 0.060 inches in thickness and having a length approximately 1 to 4 and preferably 2.5 inches and a width from 1.5 to 2 inches. These fins are spaced circumferentially around the cage 403. It is found it is preferable to nickel plate the fins 421 so they will not corrode and oxidize when heated. A fan 423 is mounted within the housing 402 and is driven by a motor 424 to force air through and between the fins 421, with nickel or silver, for example, to provide cooling to the fins which serve to radiate heat from the heat sink or heat cage 403. Thus it can be seen in the present embodiment that the fins are directly brazed to the heat cage whereas in previous embodiments the fins formed a part of the housing. The heat cage 403 is supported within the housing 402 by a mounting ring 426 by suitable means such as brazing.

The front bearing assembly 413 is supported in a fixed position by a cross bar 428 which is formed of a suitable insulating material such as a ceramic. The cross bar 428 can have a suitable width of ¾th of an inch and a suitable thickness of ¼ of an inch. The cross bar 428 is supported by standoffs or posts 429. The posts 429 are formed of tubes 431 of a suitable material such as stainless steel No. 304 having a suitable wall thickness, as for example, 0.020 inches. One end of each of the tubes 431 is brazed to the cross lid 408. A threaded screw 432 is brazed into the other end of the tube 431 and extends through the cross bar 428. The cross bar 428 is secured to the screw 432 by nuts 433. The nuts 433 serve to retain the cross bar 428 in a fixed position to support the front bearing assembly 413 in a fixed position whereas the rear bearing assembly 414 is floating in the manner hereinbefore described for the previous embodiments in which the rear bearing assembly 414 serves as the floating bearing and is provided at the cold or cooler end of what can be characterized as the motor sub-assembly 436.

The motor sub-assembly 436 (see FIG. 22) is adapted to mate with a high voltage sub-assembly 437. The high voltage subassembly 437 consists of a circular plate 438 formed of a suitable material such as stainless steel. High voltage receptacles 441 and 442 are mounted in the plate 438. The top plate 438 is brazed to a cylindrical sleeve 446 formed of a suitable material such as stainless steel. The other extremity of the sleeve 446 is bonded to the copper cross lid 408 by suitable means such as brazing. The bonds which are formed between the sleeve 446 and the top plate 438 and with the cross lid 408 should be vacuum tight.

Figure 23:
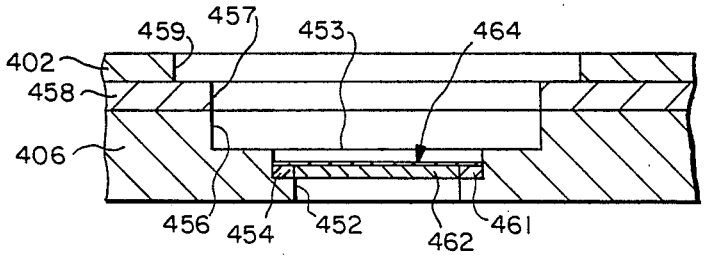
FIG. 23 is an enlarged cross sectional view of the x-ray window construction provided in the x-ray tube construction shown in FIGS. 21 and 22.

A window construction 451 for permitting x-rays to pass from the x-ray tube 401 and is shown particularly in FIG. 23. The window construction 451 is formed in the following manner. A rectangular opening 452 is provided which extends through the side wall and opens through the heat cage so that x-rays which are generated in the anode 411 can pass through the heat cage. A recess 453 of a size which is larger than the opening 452 surrounds the opening 452 and provides a shoulder 454. Another recess 456 is also provided in the side wall 406 and has a size which is greater than the recess 453 and surrounds the recess 453. An opening 457 of the same size as the recess 456 is provided in a lead liner or sleeve 458 which is formed in the manner hereinafter described which surrounds the cylindrical side wall 406 of the heat cage 403. The lead sleeve 458 is disposed between the housing 402 and the cylindrical side wall 406. The housing is provided with an opening 459 which is larger in size than the opening 457. A rectangular frame 461 formed of a suitable material such as stainless steel and having a suitable thickness such as 0.040 inches is brazed into the recess 453 and rests against the shoulder 454 by brazing the same to the copper side wall 406. The frame 461 carries a beryllium window 462 also having a suitable thickness, as for example, 0.040 inches and which also rests against the shoulder 454. The beryllium window 462 is secured to the frame 461 by brazing or loose slip fit into the frame 461. In order to provide a vacuum tight seal for the window construction 451 a thin sheet 464 of stainless steel 304 having a suitable thickness, as for example, 0.001 to 0.005 inches is also provided in the recess 453 and overlies the stainless steel frame 461 and the beryllium window 462. It is brazed to the frame 461 to form a vacuum tight seal between the side wall 406 and the opening 452. Brazing of all parts for the heat cage as fins 421 window construction 451 and rotor sleeve can be performed in one single brazing procedure.

Alternatively, the window construction 451 can be constructed by omitting the frame 461 and bonding the beryllium window 462 directly to the copper heat cage 403 onto the shoulder 454 to provide a vacuum tight seal. The beryllium window is nickel plated and then brazed to the heat cage 403 in wet or dry hydrogen atmosphere or in a vacuum brazing furnace. The nickel plating on the beryllium window protects the beryllium window in the same manner as the thin stainless steel sheet 464.

The lead sleeve or liner 458 surrounds the heat cage 403. It also surrounds the high voltage sub-assembly 437 and particularly the stainless steel sleeve 446 forming a part of the high voltage assembly. The lead sleeve liner 458 can be provided by utilizing the space between the housing 402 and the heat cage 403 and the sleeve 446 as a mold and then pouring molten lead which can have a temperature of approximately 350° C. into this space and then permitting the molten lead to harden to provide the desired x-ray shielding for the tube.

Alternatively, the lead liner or sleeve 458 can be provided by mounting a tube construction hereinbefore described in a cylindrical fixture and then casting the lead around the tube and removing the fixture.

Thereafter, the housing 402 can be slid over the lead liner to provide a direct mechanical interface between the housing, the envelope for the tube formed by the heat cage 403 and the sleeve 446.

In order to facilitate the heat interchange between the tube and the housing 402, certain additional steps can be taken. For example, the stainless steel sleeve can be nickel plated. Also the copper heat cage 403 can be provided with a nickel plating, thus facilitating good heat transfer. The use of such surfaces with the lead promotes a solder-type interface which facilitates a conduction type transfer of heat to the housing 402.

The construction of a lead liner in this manner is advantageous in the subsequent repair of the tube. If an x-ray tube is returned for repair, the housing can be slid off. The lead liner can be slid open and removed. Thereafter it can be melted down and reused again.

The window construction 451 has the same advantages of window constructions hereinbefore provided. The stainless steel wall or sheet 464 provides vacuum integrity for the tube whereas the rather thick 0.040 beryllium window avoids burnout of the stainless steel sheet 464 by substantially reducing the secondary electron bombardment without absorbing useful radiation.

A pump stud 471 has been provided in the tube near the rear end of the tube as shown in FIG. 21 and extends through the heat cage 403 and is provided for evacuating the tube envelope. The pump stud 471 is in the form of a copper tube which extends between the fins 421. When the pump down of the tube has been completed, the tube can be pinched off as shown and then can be pushed back so that it extends between two of the fins 421 and thus not interfering with the housing to be mounted around the x-ray tube.

Figure 25:
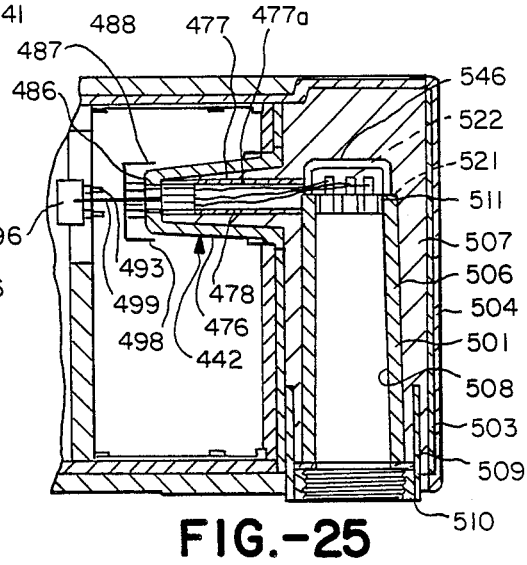
FIG. 25 is a cross sectional view of an alternative arrangement of high voltage receptacles.

Each of the high voltage receptacles 441 and 442 is provided with a cup-shaped ceramic member 476 of the type hereinbefore described. A sleeve 477 see FIG. 25 is disposed within the ceramic member 476 but outside the tube vacuum and is formed of a suitable heat conductive material such as copper. The sleeve 477 extends substantially the entire length of the interior of the ceramic member 476. It can be provided with a portion 477*a* at the lower extremity which is thicker in cross section than the remainder of the sleeve to improve heat conduction along the sleeve. An insulating material 478 of a suitable type such as RTV is provided between the interior of the ceramic member 476 and the exterior of the copper sleeve 477.

Each of the cathode and anode high voltage receptacle 441 and 442 is provided with five female terminals or receptacles 486 which are mounted in the ceramic member 441 and 442. Male plugs 487 of the banana plug type are disposed within the terminals or receptacles 486 outside the tube vacuum and are connected to conductors 488 which are connected to the federal standard terminal hereinafter described as a part of the tube.

The terminals 486 of the anode high voltage receptacle 441 are connected by a spring loaded conductor 491 (see FIG. 21) to the shaft 412 so that it applies a high voltage to the anode 411. The female receptacles or terminals 486 of the cathode high voltage receptacle 442 are connected by conductors 493 to a cathode assembly 496 of the type hereinbefore described.

A cup-shaped corona suppression member 498 (see FIG. 25) is provided around the female terminals 486. It is mounted on the ceramic member 476 by mounting posts 499. The member 498 also serve as a heat radiation barrier between interior tube components at high temperature and the RTV insulation provided in the terminal.

The sleeve 477 which is provided within as a part of the high voltage receptacle 441 and 442 serves several purposes. It serves as a corona sleeve which greatly minimizes the effect of any corona created within the ceramic member 476. The sleeve 477 performs additional functions. It is effective from transferring heat from the lowermost part of the receptacle to distribute the heat over the entire high voltage receptacle and thus serves to provide a cooling effect for at least the lower portion of the receptacle. In addition, the provision of the copper sleeve 477 reduces the amount of space which is occupied by the RTV insulating material 478. Since the volume of the RTV is reduced this reduces the amount of contraction and expansion which must be accommodated which occurs with the heating and cooling of the RTV insulating material. This is important because the RTV insulating material has a relatively high coefficient of expansion so that it expands greatly upon the application of heat. Even though this expansion occurs, the effect is much less pronounced because the amount of RTV insulating material utilized is substantially reduced by the use of the copper sleeve 477.

Figure 24:
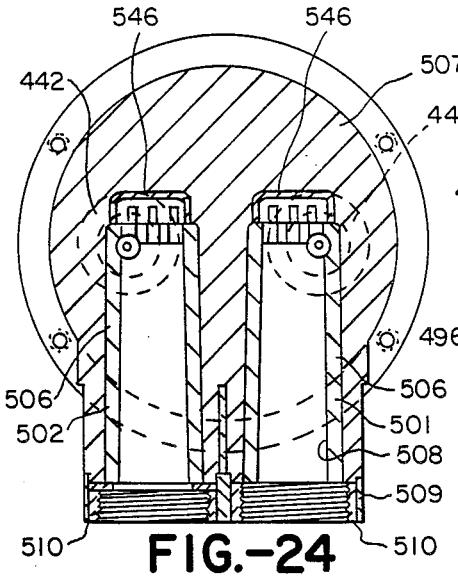
FIG. 24 is a cross sectional view taken along the line 24—24 of FIG. 21 and particularly shows the high voltage terminals and the receptacle for federal standard terminations.

First and second receptacles 501 and 502 (see FIGS. 24 and 25) are provided which are adapted to receive federal standard 72 3 or 4 pole cables. The receptacles 501 and 502 extend at approximately 90° with respect to the high voltage receptacles 441 and 442. The receptacles 501 and 502 each are provided with a sleeve 506 formed of a suitable insulating material such as a plastic. As can be seen from FIG. 24, the outer extremity of the housings 506 extend beyond the cylindrical side wall provided by the housing 402. RTV silicone rubber insulating material 507 surrounds the sleeve 506. The sleeves are provided with cylindrical recesses 508 for receiving federal standard terminations. Lead shielding 509 is provided around the frontal portions of the sleeves 506 of the receptacles 501 and 502. Threaded rings 510 of stainless steel are embedded in the lead shielding 509 for receiving the federal standard terminations. This shielding augments the other lead shielding 503 provided with the interior of aluminum cover 504 for the x-ray tube which is similar to that hereinbefore described.

A slightly different arrangement for the receptacles 501 and 502 is shown in FIG. 25 in which the receptacles 501 and 502 face in opposite directions to make maximum use of the space within the cover 504 and so that rear extremities of each of the receptacles overlies and is in line with the associated high voltage receptacle disposed at right angles thereto.

Figure 26:
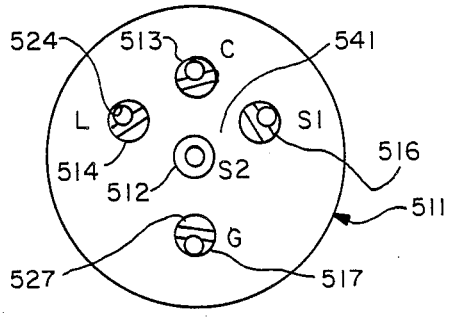
FIG. 26 is an enlarged view of one of the inserts utilized in the receptacle shown in FIGS. 24 and 25.
Figure 27:
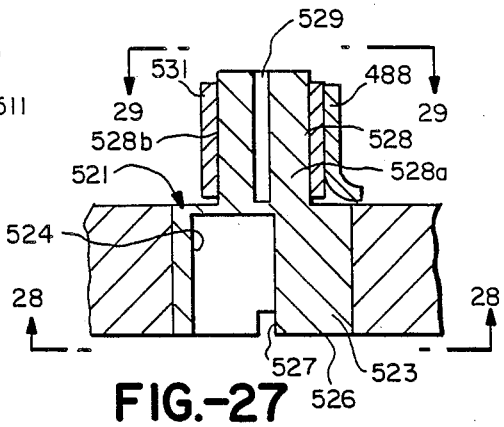
FIG. 27 is an enlarged cross sectional view of one of the eccentric pins utilized in the insert shown in FIG. 26.
Figure 28:
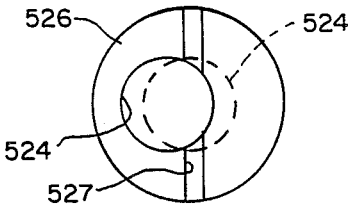
FIG. 28 is an end view looking along the line 28—28 of FIG. 27.
Figure 29:
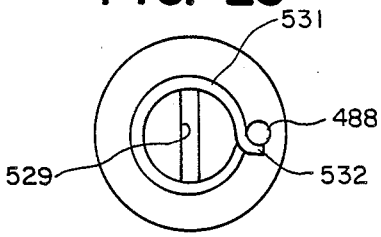
FIG. 29 is an end view looking along the line 29—29 of FIG. 27.
Figure 30:
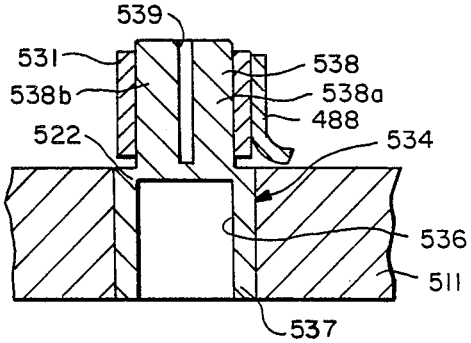
FIG. 30 is a cross sectional view of the central pin utilized in the insert shown in FIG. 26.

Each of the receptacles 501 and 502 is provided with an insert 511 of the type shown in FIG. 26. The insert 511 is in the form of a circular member formed of a suitable insulating material such as RTV silicone rubber. It is provided with the central hole 512 and four additional holes 513, 514, 516 and 517 which are spaced in predetermined positions and which are spaced between the central hole 512 and the outer margin of the insert. The holes 513, 514, 516 and 517 are adapted to receive eccentric pins 521 of the type shown in FIG. 27 whereas the central hole 512 is adapted to receive a central pin 522 of the type shown in FIG. 30. The eccentric pins 521 and the pin central 522 can be formed of a suitable electrically conductive material such as beryllium copper. Each of the eccentric pins 521 is provided with a cylindrical body 523 which has a bore 524 provided therein which opens through the forward surface 526 of the cylindrical body. The bore 524 is offset in a lateral direction from the longitudinal axis of the cylindrical body 523 by a suitable distance such as 0.062 inches. A screwdriver slot 527 also extends through the surface 526 and extends diametrically of the cylindrical body 523. The cylindrical body 523 is provided with a cylindrical protrusion 528 which is axially aligned with the cylindrical body 523. The protrusion 528 is provided with a slot 529 extending diametrically therethrough and extending the length of the protrusion so that the protrusion is in the form of two parts 528*a* and 528*b*. A removable spring clip 531 formed of a suitable material such as beryllium copper is mounted on the protrusion 528. The clip 531 is provided with an extension 532 which is adapted to have one of the conductors 488 brazed or soldered thereto to form an electrical connection.

The central pin 522 is provided with a cylindrical body 534 which has a centrally disposed bore 536 opening through the forward surface 537 thereof. The bore 536 is the same size as the bore 524 provided in the pin 521 and is adapted to receive a male plug of the banana type. The pin 522 is also provided with a cylindrical protrusion 538 which is formed integral with the cylindrical body 534. A slot 539 is formed therein extending diametrically thereof and extending the length thereof which serves to divide the cylindrical protrusion 538 into portions 538*a* and 538*b*. A spring clip 531 of the type hereinbefore described with the pin 521 is mounted on the protrusion 538 and is also adapted to be connected to one of the conductors 488.

The use of the off-centered or eccentric pins 521 makes it very easy to accommodate either a three-pole or four-pole federal standard termination carrying male terminals. By rotating the pins 521 by the rise of the screwdriver slots, it is possible to position the three pins in the holes 513, 514, 516 and 517 so that the bores 524 are in alignment with a bolt circle of 0.687 inches to make it possible to mate with a federal standard three pole termination. Similarly by rotating the eccentric pins 521 to other positions, the pins provided in the holes 513, 514, 516 and 517 can be rotated so that the bores 524 therein are in alignment with a bolt circle of 0.812 inches which corresponds to the federal standard 4 pole termination. If additional connections are required, they can be readily accomplished by placing the conducting wires as, for example, by the use of a conductor 541 which can be brazed or soldered to the appropriate terminals. Thus as shown in FIG. 26, a conductor 541 can be utilized for connecting the pins in the holes 512 and 516 which are carrying the pins for the terminals S1 and S2.

It can be seen that with the foregoing construction that by utilizing the appropriate pins in the insert and additional simple wiring it is possible to provide a number of combinations, for example, it is possible to provide three focus spots for equipment having such capabilities or two focus spots. In addition to providing this great flexibility for different applications, the x-ray tube construction readily meets radiation safety requirements because the housing itself is shielded along its cylindrical surface and the receptacles 501 and 502 are shielded by a cast lead structure as shown in FIG. 25. Also in order to minimize radiation escaping from the x-ray tube, a folded terminal arrangement is provided in which the high voltage receptacles 441 and 442 are disposed at right angles with respect to the receptacles 501 and 502.

In order to minimize the effects of corona, a cup-shaped member 546 is provided which surrounds the protrusions 528 on the pins 521 and the protrusions 538 on the pins 522. This cup-shaped member 546 is secured to the sleeve 477 and the sleeve 477 is connected to a clip 531 mounted on one of the protrusions 528 carried by the insert 511. As in the previous embodiments, the receptacles 501 and 502 are surrounded with a suitable insulating material such as the RTV silicone rubber.

Operation and use of the x-ray tube construction shown in FIGS. 21–30 may now be briefly described as follows. In general, the operation is very similar to that of the constructions hereinbefore provided. However, the x-ray tube construction in the present embodiment has greater heat dissipation capabilities because of the relatively massive copper heat cage 403 which is provided which has a relatively thick bottom wall or end plate 404 and a relatively thick cylindrical side wall 406 which have the capability of transferring large quantities of heat through the lead to the aluminum housing 402 end to the fins 471 which are to be brazed thereto and which are provided with cooling air from he fan 423 which flows through the fins in a general manner indicated by the arrows 551. Excellent heat transfer characteristics are also obtained because the cross lid is bonded with a very good bond as, for example, the electron beam weld hereinbefore described to the heat cage 403. This bond, as hereinbefore described, in addition to providing a good mechanical heat transfer bond also provides a good vacuum tight seal for the interior of the tube.

In the event it is necessary to repair the tube, the aluminum housing 402 can be removed. The lead sleeve 458 can be cut and peeled off. This exposes the heat cage assembly comprised of the heat cage 403 and the cross plate 408 and the weld line 409. This heat cage can be opened up by machining a groove into the heat cage of a suitable width, as for example, approximately ⅛th of an inch making it possible to remove the cross lid 408 and giving access to the interior components. As soon as the necessary repairs have been made, a ring of the same thickness as the material removed during the machining operation, as for example ⅛th inch thickness and formed of the same material as the heat cage can be inserted between the top of the heat cage 403 and the cross plate 408. In place a single electron beam weld, two electron beam welds can be provided to form the good mechanical seal between the parts as well as a good vacuum seal. The lead sheath and the exterior housing can then be replaced in the same manner as hereinbefore described in connection with the original fabrication of the x-ray tube.

In addition to the foregoing, the x-ray tube construction shown in FIGS. 21 through 30 has numerous advantages which were pointed out in connection with the description of each of the several portions of the x-ray tube which are different from the previous embodiments.

Figure 31:
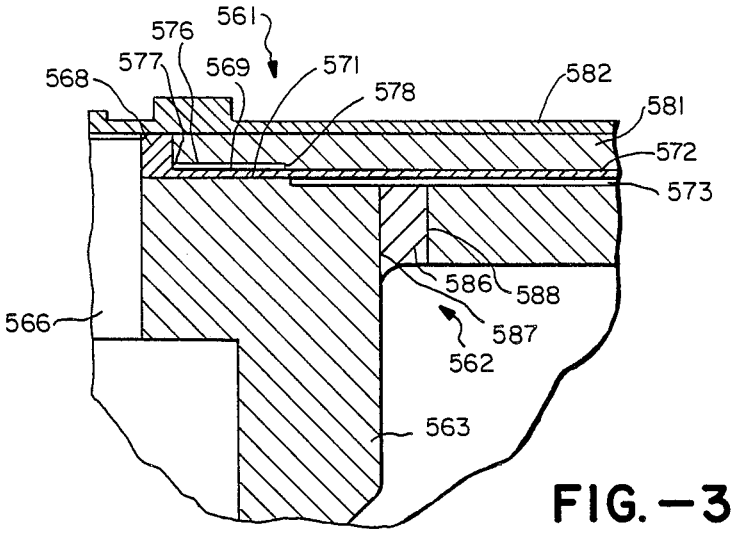
FIG. 31 is a partial cross sectional view of another embodiment of an x-ray tube construction incorporating the present invention utilizing a double wall construction.

In FIG. 31 there is shown a partial cross sectional view of an x-ray tube construction which utilizes a double wall construction. The view which is shown in FIG. 31 is the view showing the tube after it has been originally manufactured and then returned for repairs and reworked. The x-ray tube construction 561 shown in FIG. 31 is comprised of a heat cage 562 formed of the same copper type material hereinbefore described which is provided with a bottom or end wall 563 and a cylindrical side wall 564. Fins 566 are brazed to the end wall 563. A mounting ring 568 is provided for mounting the heat cage 562. The mounting ring 568 is provided with an integral upstanding sleeve 569 also formed of stainless steel which is abutted against the lower extremity of the sleeve 572 along the line 571. The cylindrical sleeve 572 forms a part of a high voltage terminal assembly of the type hereinbefore described. The heat cage 562 is formed in such a manner so that when the sleeve 572 is mounted thereon, an annular space 573 at a suitable thickness as, for example, 0.040 inches is provided between the exterior surface of the side wall 564 and the interior surface of the sleeve 572.

In order to provide vacuum integrity for the tube a ring 576 formed of a suitable material such as stainless steel of a suitable thickness as, for example, 0.005 inches is wrapped around the portion of the sleeves 569 and 572 and overlaps the line 571. This ring 576 is welded to the mounting ring 568 by a TIG weld along the line 577 and to the sleeve 572 along the weld line 578, providing a vacuum-tight bridge member over the joint 571 and to thereby seal off the tube The x-ray tube construction also includes the lead sleeve 581 which can be formed in the manner hereinbefore described which is enclosed by the aluminum housing 582.

Let it be assumed that an x-ray tube utilizing the construction shown in FIG. 31 has been returned for repairs. The tube can be readily opened by removing the housing 582, slitting the lead sheath 581 and removing the lead sheath or sleeve giving access to the heat cage, further removing thin sleeve 576 and thereby permitting removal of the sleeve 572. The heat cage can then be machined open by machining at the bottom extremity of the wall adjacent the end place 563. After the tube has been opened for repair and it is desired to close it again, a ring 586 formed of the same material as the heat cage can be utilized. This ring has the same thickness as the material which has been removed during the prior machining operation. Thereafter, first and second electron beam welds along the lines 587 and 588 can be provided to establish good mechanical heat transfer. The sleeve 572 is put in place and thereafter the ring 576 welded in place to provide the desired vacuum integrity. Thereafter, the lead sleeve 581 can be installed with the housing 582.

Figure 32:
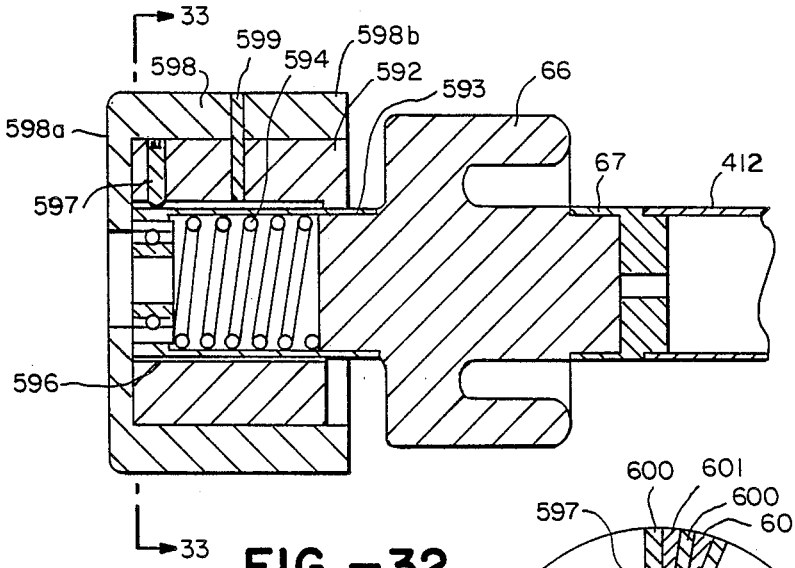
FIG. 32 is a partial side elevational view showing an alternative bearing support for the x-ray tube construction shown in the present invention.
Figure 33:
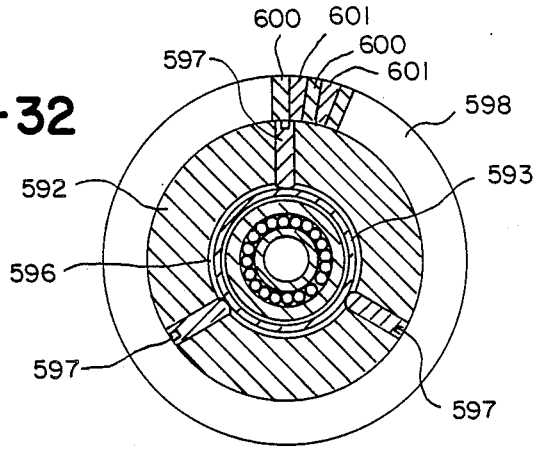
FIG. 33 is a view taken along the line 33—33 of FIG. 31.

An alternative embodiment of a rear bearing support assembly 591 is shown in FIGS. 32 and 33. As shown, the shaft 412 is connected in a conventional manner to a ceramic coupling 66 by the use of a Kovar ring 67. The rear shaft support assembly 591 is provided with a rotor support 592. The rotor support 592 is bonded to a Kovar sleeve 593 which is bonded to the ceramic coupling 66. The outer race of the ball bearing assembly 81, rather than being directly mounted in the rotor support 592 is slipped into the sleeve 593 and the force of a helical spring 594 disposed within the sleeve 593. The sleeve 593 is of such a size so that there is an annular space 596 provided between the sleeve 593 and the rotor support 592. The rotor support 592 is centered or balanced with respect to the sleeve 593 by three adjustment screws 597 as shown particularly in FIG. 33. A cup-like rotor 598 is mounted over the rotor support or core 592 and is secured to the rotor support by a dowel pin 599. The rotor is provided with an annular flange portion 598*a* which underlies the outer race of the ball bearing assembly 81 and retains the bearing assembly 81 on the shaft 412. The rotor is formed of a plurality of elongate segments 600 of a suitable magnetic material which are rectangular in cross section. The segments are cast in a suitable conducting material such as copper or a copper alloy to provide copper segments 601 disposed on opposite sides of the magnetic steel segments. With the arrangement shown in FIGS. 32 and 33, it can be seen that every other segment is formed of magnetic steel and the intervening segments are formed of copper so that each steel segment has a copper segment on opposite sides of the squirrel cage rotor 598.

The sleeve 593 serves as a heat choke and helps to keep the outer bearing assembly 81 cool during operation of the x-ray tube. It can be seen that the bearing assembly 81 is separated from the rotor support 592 by the annular space 596 and that is necessary for heat to travel to the bearing assembly 81 must travel through the relatively thin Kovar sleeve having a thickness of approximately 0.020 inches. The split rotor construction with a separate rotor core 592 and rotor 598 facilitates manufacture. The use of the separate rotor core or support 592 facilitates brazing of the rotor support or core to Kovar sleeve 593 and brazing of the sleeve 593 to the ceramic coupling 66 in a single operation. The rotor 598 can thereafter be affixed as hereinbefore described.

Figure 34:
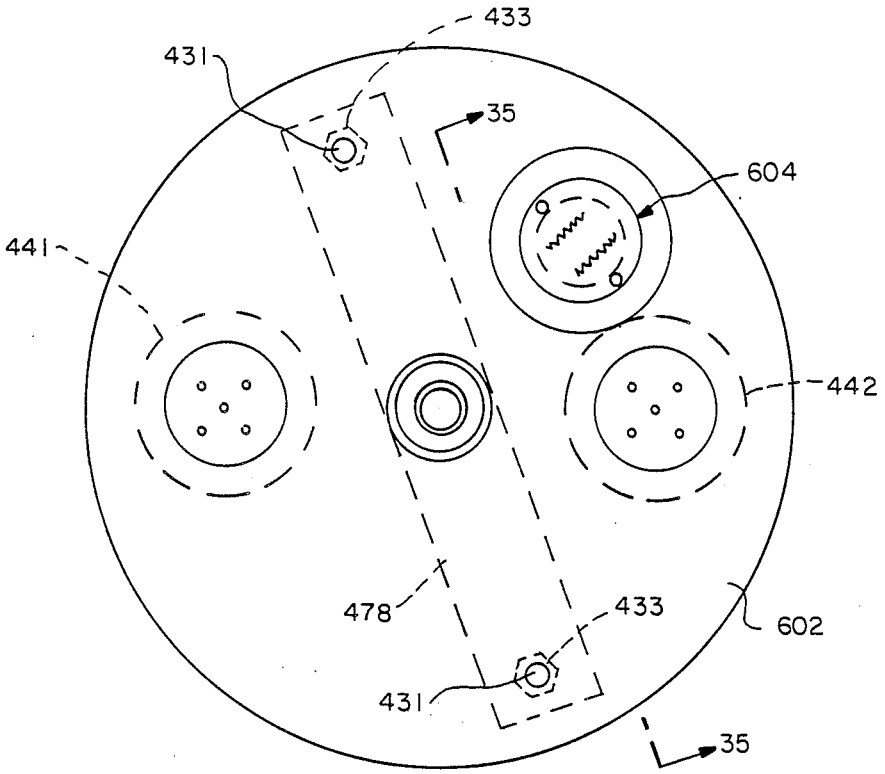
FIG. 34 is cross sectional view of another embodiment of an x-ray tube construction incorporating the present invention taken along the line 34—34 of FIG. 35 and showing an offset cathode assembly.
Figure 35:
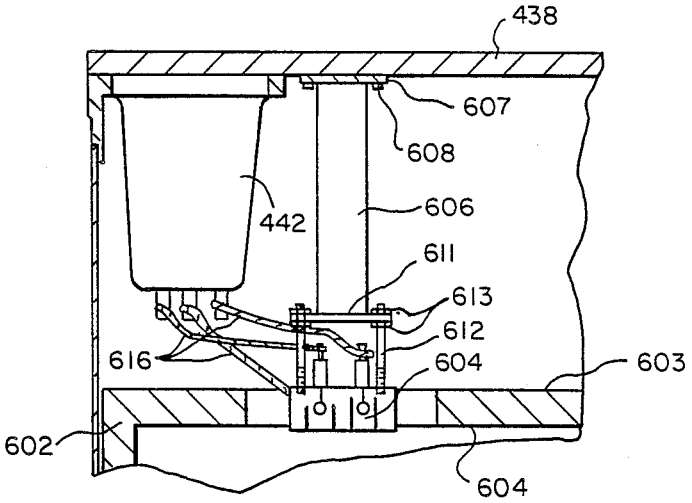
FIG. 35 is a cross-sectional view taken along the line 35—35 of FIG. 34.

Still another embodiment of an x-ray tube construction incorporating the present invention is shown in FIGS. 34 and 35 in which an offset cathode assembly is provided. In the previous embodiments, the cathode assembly has been in alignment with the high voltage receptacle for the cathode which in many cases has caused undue heating of the RTV of the high voltage receptacle. In order to overcome this problem, the arrangement shown in FIGS. 34 and 35 is utilized. In this embodiment of the x-ray tube construction, a heat cage 602 is provided which has a cross plate 603 having an opening 604 therein in which there is disposed a cathode assembly 605 of the type hereinbefore described. The cathode assembly 605 is offset so it is out of alignment with the high voltage cathode receptacle 442 as shown particularly in FIG. 34. The cathode assembly is mounted upon the top late 438 which carries the receptacle 442 in a suitable manner such as by use of an insulating ceramic rod 606 which is brazed to a small plate or washer 607 formed of a Kovar. The Kovar washer 607 is secured to the top plate 438 in a suitable manner such as by screws 608. The other end of the ceramic rod is provided with another circular plate or washer 611 which is brazed to the ceramic rod 606. The cathode assembly 605 is secured to the washer 611 in a suitable manner as for example by the use of standoff screws 612 which are threaded into the cathode assembly and which are adjusted in an appropriate position by having the screws 612 extend through the washer 611 and holding the cathode assembly in a desired position by nuts 613 threaded onto the screws on opposite sides of the washer 611. Conductors 616 are provided for making the connections from the cathode assembly 604 to the receptacle 442 as shown particularly in FIG. 35.

It can be seen by offsetting the cathode assembly 604 in this manner, the heat generated by the cathode assembly 442 is spaced away from the high voltage receptacle 442 to thereby reduce the heat to which the high voltage receptacle 442 is subjected to. This helps to ensure that there will not be failures in the high voltage receptacle 442.

It can be seen from the foregoing that there has been provided a metal ceramic x-ray tube construction which has many advantageous features. The need for an insulating oil bath has been eliminated while still making it possible to operate the tube with forced air cooling and in certain compact smaller size versions to operate the tube without forced air cooling. As can be seen particular attention has been paid to the manner in which heat is dissipated from the anode while at the same time protecting the bearings supporting the shaft from heat generated by the anode. A particular unique x-ray window has been provided as well as improved cable terminations. The x-ray tube is constructed in such a manner so that repairs can be accomplished with ease. The construction is such that when the tube is returned to the manufacturer many of the expensive parts thereof can be salvaged and used in remanufactured tubes. The construction of the tube is such that the anode and cathode feedthroughs are mounted to accommodate a long shaft so that one extremity of the shaft can extend therebetween.

We claim:

1. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said anode shaft being provided with a shoulder, said anode plate engaging the shoulder secured to the shaft by a coupling together with an anode washer engaging the anode plate and means yieldably engaging the anode washer to urge the washer towards the anode plate and the anode plate towards the shoulder, said coupling being removably secured to the anode plate and to the shaft.

2. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said anode shaft being provided with a shoulder, said anode plate engaging the shoulder, a pin extending transversely of the shaft and overlying the anode plate and spring means yieldably engaging the pin to urge the pin towards the anode plate and the anode plate towards the shoulder, said pin being removably mounted in said shaft.

3. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said metal envelop being provided with a thin wall portion in registration with the window in the heat cage together with a beryllium window disposed between the heat cage and the metal envelope serving to protect the thin wall portion of the metal envelope from destruction by secondary electrons, said thin wall portion of the metal envelope being thinner than the remaining portions of the metal envelop.

4. An x-ray tube construction as in claim 3 wherein said beryllium window has a curved configuration in one direction and means for mounting said beryllium window between said heat cage and said envelope.

5. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surrounding the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means, said housing having windows in registration to permit x-rays to pass therethrough, anode and cathode feedthroughs disposed within the housing, first and second receptacles carried by the housing and in electrical contact with the anode and cathode feedthroughs and inserts carried by the receptacles for receiving a preselected termination.

6. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means, said housing having windows in registration to permit x-rays to pass therethrough, anode and cathode feedthroughs disposed within the housing, cable terminals connected to the anode and cathode feedthroughs, each cable terminal comprising a cable end having conductors therein, fittings mounted on said conductors and a vulcanized rubber preform surrounding said cable and carrying said fittings.

7. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said heat cage being provided with first and second end walls and a cylindrical side wall, said first and second end walls and said cylindrical side wall being bonded together into a unitary assembly by at least one electron beam weld, said electron beam weld establishing a good mechanical contact to facilitate the transfer of heat between the end walls and the cylindrical side wall.

8. A x-ray tube construction as in claim 7 together with a ring and means for bonding the ring to the cylindrical side wall and to one of said end walls by the use of at least two electron beam welds extending circumferentially around the ring to facilitate the transfer of heat between the end wall and the side wall.

9. An x-ray tube construction as in claim 7 together with first and second cylindrical sleeve portions extending over the heat cage and having ends thereof in juxtaposition with each other, at least a portion of the sleeve being formed so that there is provided a space between the sleeve and at least a portion of the heat cage.

10. An x-ray tube construction as in claim 8 together with a metal band extending over the jaxtaposed ends of the sleeve portions and means forming welds between the band and the sleeve portions to provide vacuum tight seals between the band and the sleeve portions.

11. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, first and second receptacles carried by the housing for receiving a termination, conductive means connecting the first receptacle to the anode, conductive means connecting the second receptacle to the cathode, each of the receptacles having a cup-shaped member formed of insulating material which is open at one end and adapted to receive a termination, an insert disposed in at least one of the receptacles and being mounted in the member, the insert having a plurality of holes therein, pins formed of a conductive material disposed int he holes, each of the pins having a bore therein for receiving a male terminal of the termination, said bores provided in said pins being offset from the longitudinal axis of the pins by a predetermined distance, means carried by the pins to facilitate rotational movement of the pins in the holes in the insert so that the bores of at least certain of the pins in one rotated position are positioned so that they line in a circle of one dimension to accept a three-pole termination and in another rotated position are positioned so that they lie in a circle of another dimension to accept a four-pole termination, said conductive means being connected to the pins of the respective receptacle.

12. An x-ray tube construction as in claim 11 wherein each of said pins is provided with a protrusion extending beyond the insert, a removable clip carried by each of the inserts and wherein the conductive means includes a plurality of conductors and wherein one conductor is connected to each of said clips.

13. An x-ray tube construction as in claim 11 wherein one of the holes is centrally disposed in the insert and wherein the pin disposed in the central hole is provided with a bore which is axially aligned in the pin and wherein the other pins in the insert are provided with offset bores.

14. An x-ray tube construction as in claim 12 wherein said means to facilitate rotational movement of the pins in the holes is in the form of a screwdriver-like slot extending diametrically of the pin.

15. An x-ray tube construction as in claim 14 wherein each of said receptacles is provided with an insert.

16. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, a high voltage receptacle, means connecting the high voltage receptacle to the cathode, the high voltage receptacle comprising a cup-shaped ceramic-like member having a bottom wall, a side wall and an open end, connector means extending through the bottom wall, a sleeve of conductive material disposed within the cup-shaped member, conductor means extending through the bottom wall and extending out through the opening in the member and within the sleeve of conductive material, said sleeve serving to minimize the effects of corona generated within the sleeve and an insulating material disposed between the sleeve and the side wall of the cup-shaped member.

17. An x-ray tube construction as in claim 16 wherein said insulating material is formed of an RTV silicone rubber.

18. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said shaft including a ceramic bushing, said motor drive means including a metallic sleeve having first and second ends with the first end being secured to the ceramic bushing, a bearing assembly having an outer race disposed within the second end of said sleeve, a rotor support member secured to the sleeve, the rotor support member being formed so that there is a space provided between the sleeve and a substantial portion of the rotor support member so that the sleeve serves as a heat choke to minimize the amount of heat which travels from the shaft to the bearing assembly.

19. An x-ray tube construction as in claim 18 together with adjusting means carried by the rotor support and engaging the sleeve so that the rotor support can be centered with respect to the sleeve.

20. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said shaft including a ceramic bushing, said motor drive means including a metallic sleeve having first and second ends with the first end being secured to the ceramic bushing, a bearing assembly having an outer race disposed within the second end of said sleeve, a rotor support member secured to the sleeve, the rotor support member being formed so that there is a space provided between the sleeve and a substantial portion of the rotor support member so that the sleeve serves as a heat choke to minimize the amount of heat which travels from the shaft to the bearing assembly, said motor drive means also including a squirrel cage rotor removably secured to the rotor support and having a portion thereof extending over the outer race of the bearing assembly.

21. An x-ray tube construction as in claim 20 wherein said rotor drive means includes spring means disposed within the sleeve and engaging the outer race of the bearing assembly to yieldably urge the outer race into engagement with the portion of the rotor engaging the outer race.

22. An x-ray tube construction as in claim 20 wherein the squirrel cage rotor is comprised of a plurality of spaced apart magnetic steel segments and conductive segments formed of a conductive material disposed between the magnetic steel segments so that each magnetic steel segment is separated from another magnetic steel segment by a conductive segment.

23. An x-ray tube construction as in claim 22 wherein said segments of conductive material are formed of copper.

24. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, and x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said motor drive means including a rotor support mounted in the housing and a removable squirrel cage rotor secured to said rotor support.

25. An x-ray tube construction as in claim 24 wherein said rotor is formed of a plurality of segments with alternating segments being formed of magnetic steel and the other segments being formed of conductive material.

26. An x-ray tube construction as in claim 25 wherein the conductive material is cast copper.

27. An x-ray tube construction as in claim 24 wherein said motor drive means includes a bearing assembly having an outer race, means secured to the rotor and underlying the outer race to retain the outer race and means removably securing the rotor to the rotor support.

28. An x-ray tube construction as in claim 27 wherein said motor drive means includes spring means yieldably urging the outer race of the bearing towards the means supporting the outer race connected to the rotor.

29. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, the voltage means connected to the cathode including a high voltage receptacle disposed within the housing having an insulating compound therein, the heat cage having an opening therein which is offset in a lateral direction from the high voltage receptacle for the cathode and means for supporting the cathode in the opening, conducting means connecting the cathode to the high voltage receptacle, the cathode being offset from the high voltage receptacle for the cathode so that the heat generated by the cathode has less effect on the high voltage receptacle.

30. An x-ray tube construction as in claim 29 together with a mounting plate and wherein said high voltage receptacle is mounted on said mounting plate and wherein said means for supporting the cathode is mounted on the same mounting plate.

31. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a heat cage disposed in the housing and surround the anode plate, a metal evacuated envelope disposed within the housing and enclosing the heat cage, x-ray shielding means disposed between the housing and the envelope and in intimate contact with the housing and the envelope to form a heat conducting path between the envelope and the housing, said heat cage, said shielding means and said housing having windows in registration to permit x-rays to pass therethrough, said means for mounting said shaft including means permitting compensation movements of the shaft during operation of the x-ray tube so that the anode plate remains in a relatively stationary position with respect to movement longitudinally of the axis of the shaft.

32. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate, a cathode for supplying electrons, voltage means connected to the anode plate and to the cathode for accelerating the electrons so the electrons impinge upon the anode plate to create x-rays, a thick-walled metal heat cage disposed in the housing between the front and rear bearing means and substantially enclosing the anode plate, a metal evacuated envelope disposed within the housing and sealingly engaging the heat cage, said heat cage being comprised of two parts and means forming a mechanical bond between said two parts to provide heat transfer between the two parts.

33. A x-ray tube construction as in claim 32 wherein said means forming a mechanical bond is an electron beam weld.

34. In an x-ray tube construction, a housing, a shaft having an exterior surface and front and rear ends, an anode plate carried by the shaft, front and bearing means disposed on opposite sides of the anode plate for rotatably mounting the front and rear ends of the shaft in the housing, a cathode for supplying electrons, voltage means connected to the anode plate and to the cathode for accelerating the electrons so the electrons impinge upon the anode plate to create x-rays, a metal evacuated envelope disposed within the housing and enclosing the shaft and the anode plate, and squirrel cage motor drive means coupled to the shaft for rotating the shaft and the anode plate, said squirrel cage motor drive means having a rotor support secured to the shaft and a rotor removably secured to the rotor support, said rotor being comprised of a plurality of spaced apart magnetic steel segments and conductive segments formed of a conductive material disposed between the magnetic steel segments so that each magnetic steel segment is separated from another magnetic steel segment by a conductive segment.

35. In an x-ray tube construction, a housing, a shaft having an exterior surface and front and rear ends, an anode plate carried by the shaft, front and rear bearing means disposed on opposite sides of the anode plate for rotatably mounting the front and rear ends of the shaft in the housing, motor drive means coupled to the shaft for rotating the shaft and the anode plate and to the cathode for accelerating the electrons so the electrons impinge upon the anode plate to create x-rays, a heat cage having a cylindrical side wall and a bottom wall disposed in the housing and surrounding the anode plate, said heat cage having a relatively thick bottom wall in comparison to the side wall to provide x-ray shielding by the bottom wall and a plurality of spaced apart fins secured to the bottom wall.

36. An x-ray tube construction as in claim 35 wherein said heat cage and said finds are formed of copper.

* * * * *